US006557364B2

(12) United States Patent
Gunji et al.

(10) Patent No.: US 6,557,364 B2
(45) Date of Patent: May 6, 2003

(54) AIR CONDITIONER

(75) Inventors: Yoshihiro Gunji, Kawasaki (JP); Shinji Tateyama, Kawasaki (JP); Yukihiko Imai, Kawasaki (JP); Tooru Koyama, Kawasaki (JP); Takehiro Hatanaka, Kawasaki (JP); Yasuhiro Aketa, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 10/091,523

(22) Filed: Mar. 7, 2002

(65) Prior Publication Data

US 2002/0144513 A1 Oct. 10, 2002

(30) Foreign Application Priority Data

Apr. 5, 2001 (JP) ..... 2001-106716

(51) Int. Cl.[7] ..... F25D 23/12; F25D 19/00
(52) U.S. Cl. ..... 62/263; 62/298; 62/285
(58) Field of Search ..... 62/263, 298, 285, 62/428, 259.1

(56) References Cited

U.S. PATENT DOCUMENTS 5,388,426 A * 2/1995 Wada et al. ..... 62/263
5,417,279 A * 5/1995 Wada ..... 165/122

FOREIGN PATENT DOCUMENTS

JP 11006633 A * 1/1999

* cited by examiner

*Primary Examiner*—Chen Wen Jiang
(74) *Attorney, Agent, or Firm*—Kanesaka & Takeuchi

(57) ABSTRACT

In an air conditioner with a front panel projected forward, in order to increase stiffness of a body cabinet and to improve maintainability and appearance, the body cabinet is composed of: a base panel; a top panel; and a front panel, and the front panel is formed only with an air outlet port to be finished into a refined appearance having less seams, and it is adopted as basic configuration to support a front end side of the top panel by a drain pan, and further a front end side of the front panel and the front end side of the top panel are coupled to each other.

22 Claims, 24 Drawing Sheets

AIR CONDITIONER

TECHNICAL FIELD

The present invention relates to a separation type air conditioner, and more particularly to an air conditioner having a body cabinet similar to a ceiling suspension type pattern while being a wall-mounted type.

BACKGROUND ART

Currently, a dominating air conditioner (indoor unit) is the wall-mounted type, and air conditioners designed in various ways have been supplied to a market. From among those, a consumer selects, and on purchasing, be a design as it may, emphasis may be placed on an installation place in terms of relationship with a housing space (arrangement of rooms).

For example, when installing at a window, a wall surface over the window is sometimes narrow in height and width because a curtain rail or the like are fitted, and therefore, an air conditioner having a pattern which does not require as much wall surface space as possible is desired.

Japanese Patent Application published under Publication No. 5-99454 discloses an example of air conditioners capable of complying with such desire. FIG. 24 is a perspective view showing the wall surface fitting state, and FIG. 25 is a sectional view illustrating an internal structure.

A body cabinet 1 of this air conditioner is composed of: a top panel 2 opposite to a ceiling surface; a bottom panel 3 opposite to a floor surface; a front panel 4; and a base panel 5 to be fitted to the wall surface, and has a heat exchanger 6, a blow fan 7 or the like therein. The front panel 4 is provided with an air inlet port 4*a,* and behind the bottom panel 3, there is provided an air outlet port 3*a* having a louver 8.

Referring to FIG. 25, this body cabinet 1 is such that a height on the front panel 4 side is formed to be smaller than a height H2 on the base panel 5 side, and that the bottom panel 3 is constituted by a circular arc surface which inclines from the front panel 4 toward the base panel 5 side. Thereby, wall surface installation space is made narrower, and when installed near a ceiling, it has been arranged such that such an appearance as a ceiling suspension type is given at a glance.

When, however, the top panel 2 and the bottom panel 3 are caused to project forward as described above, it becomes more difficult than a thin type air conditioner to support each panel by means of the base panel 5, and stiffness of the body cabinet 1 and assembly workability become an issue.

Since particularly for a large-sized air conditioner with a width of about 1500 mm, the panel is prone to be warped, it becomes a problem to handle its seam or the like clean. Also, since the air inlet port 4*a* is at an elevated place on the ceiling side, it becomes difficult to clean its filter, and it becomes a problem how maintenance should be facilitated.

SUMMARY OF THE INVENTION

According to the present invention, in an air conditioner in which the front panel is caused to project forward like the ceiling suspension type in order to reduce the wall surface installation space while being the wall suspension type, it is possible to enhance stiffness of the body cabinet, to enable a reasonable assembly operation to be performed, and to further improve maintainability such as filter cleaning. Also, a body cabinet having less seams and presenting a refined appearance can be obtained.

For this reason, the present invention includes several features, and as one of them, there is provided an air conditioner having a body cabinet including: a base panel fixed to an indoor wall surface through predetermined fixing means; a front panel formed like a ship bottom in cross section such that a rear end thereof is latched to a lower end of the base panel and a front end side curves upwardly; and a top panel, the rear end of which is latched to the top end of the base panel and the front end of which is butted against the front end of the front panel, in which on the base panel, a cross flow fan and a box for electric are arranged side by side, and a heat exchanger and a drain pan are mounted; on the side of the rear end of the front panel, there is provided an air outlet port; and the top panel is provided with an air inlet grille having a filter, characterized in that the front end of the top panel is fixed to the drain pan.

Thereby, a stiffness of the body cabinet is significantly improved. As a result, it requires a small number of ribs for obtaining strength, and an amount of use of molding material can be reduced. On fixing the top panel, in terms of assembly workability, on the side of the front end of the top panel, there is formed a latching slit; on the drain pan side, there is provided a latching pawl, and a front end of the top panel is preferably fixed to a drain pan by means of a latching slit and a latching pawl.

As the latching pawl, there is preferable the latching pawl, which is shaped like a T-character in cross section, at least on one edge of which a pawl to be latched within the latching slit is formed, and the other edge of which is located in the outside of the latching slit as a latch-releasing one, and which is rock-able like seesaw.

It is also one of features of the present invention that the drain pan is attachable to or detachable from the base panel, whereby any seriously dirty drain pan portion is removed and can be easily cleaned.

As a preferable mode on making the drain pan attachable or detachable, it is advisable to cause a front air direction guide (front-guide) of the base panel to support the drain pan body to be arranged along the lower end of the heat exchanger, and to fit mounts for drain pan to be formed at both ends of the drain pan body in predetermined region on the base panel for holding.

The box for electric is detachably provided with a service cover constituting one portion each of the top panel and the base panel respectively in appearance, whereby the maintainability can be improved while the appearance quality is being enhanced.

According to the present invention, an air passage along the rear air direction guide (rear-guide) to be formed on the base panel is shortened by an amount corresponding to a height dimension of the base panel to be made smaller, but at a rear end edge of the air outlet port, there is pivotally provided a diffuser continuing to the rear air direction guide, whereby a blast intensifying effect can be promoted.

Also, according to another feature of the present invention, in order to facilitate cleaning of a filter, the air inlet grille has a fixed grille formed integrally with the top panel on the side of the rear end of the top panel, and a movable grille provided detachably from the top panel on the side of the front end thereof, and the filter is held by the movable grille and is made attachable to or detachable from the top panel.

The filter includes a corrugated filter and a plane filter provided contiguously to one edge of the corrugated filter, and the corrugated filter is preferably held by the movable grille. Also, in order to increase an amount of air draft, it is preferable that the fixed grille is substantially parallel with an indoor ceiling surface and the movable grille is inclined obliquely downward.

On both sides of the rear end of the movable grille, there are formed bearing fitting channels which are rotatable and attachable to and detachable from the fixed grill, and between the side of the front end of the movable grille and the top panel, there is provided engagement means consisting of an engagement projection and an elastically deformable engagement pawl, whereby attachment and detachment of the movable grille can be facilitated and the movable grille can be reliably fixed onto the top panel.

On the side of the rear end of the movable grille, there is provided a grille retainer to a front end frame of the fixed grille, whereby deformation of the fixed grille can be prevented. The grille retainer is preferably provided with two grille retainers for retaining the front end frame from both upper and lower sides.

Also, according to another feature of the present invention, the front panel includes a pair of left and right side plates formed so as to cover both side walls of the base panel; each side wall of the base panel is provided with a front panel guide for guiding the front panel to a latching position with respect to the base panel, and on the inner surface of each side plate of the front panel, there is formed a hook capable of sliding along the front panel guide.

It is preferable that the above described front panel guide is an L-character shaped body in cross section including a base plate substantially perpendicular to the side wall and a guide plate bent upwardly from the same base plate and for forming a guide groove with the side wall, and that the hook is an inverted L-character shaped body in cross section including a hook body to be placed on the top end of the guide plate, and an engagement rib bent downward from the same hook body and for entering the guide groove, whereby it is possible to prevent the side plate of the front panel from being opened toward the outside.

The front end of the front panel guide on an anti-base panel side is arranged at a lower position near the indoor floor surface than the rear end on the latching position side, and between the front end and the rear end of the front panel guide, there is preferably provided a slope with a predetermined angle, whereby the front panel can be mounted onto the base panel from obliquely below so as to avoid a louver or the like provided on the base panel.

In order to further facilitate this mounting, in the hook, there is formed an engagement projection to be inserted and fitted in a latching channel at a latching position of the base panel, and on sliding the hook along the front panel guide, it is preferable to arrange such that the engagement projection runs onto the slope and the front panel is inclined at a predetermined angle.

Also, the guide plate is preferably formed such that the groove width of the guide groove is wide on the front end side of the front panel guide on the anti-base panel side and gradually becomes narrower as the rear end side on the latching position side is reached. Thereby, it is possible to facilitate causing the engagement rib of the hook to enter the guide groove, and at a mounting termination position of the front panel, its side plate can be strongly drawn toward the side of the side wall of the base panel.

On mounting the front panel onto the base panel from obliquely below, in order to prevent from bumping against the louver or the like, on each side wall of the base panel, there is preferably further provided a restriction guider for preventing the front panel from being lifted up higher than a predetermined height position on mounting the hook on the front panel guide.

The front panel has a screwing boss for the base panel on the inner surface on the rear end side thereof, and on mounting the panel, even if the boss abuts against the louver or the like, in order to prevent the panel from being caught in it, the boss is preferably provided with a slope which inclines on the anti-base panel side.

According to a preferred aspect of the present invention, in order to increase stiffness of the body cabinet and to improve assembly workability, at a front end of the top panel, there is provided an engagement hole having an elastically deformable engagement pawl therein, and at a front end of the front panel, there is provided an engagement projection which is inserted and fitted in the engagement hole to be captured by the engagement pawl. Also, between the base panel and the front panel, there is also provided uneven fitting means, and a predetermined portion of the front panel is supported by the base panel.

DETAILED DESCRIPTION

Figure 1:
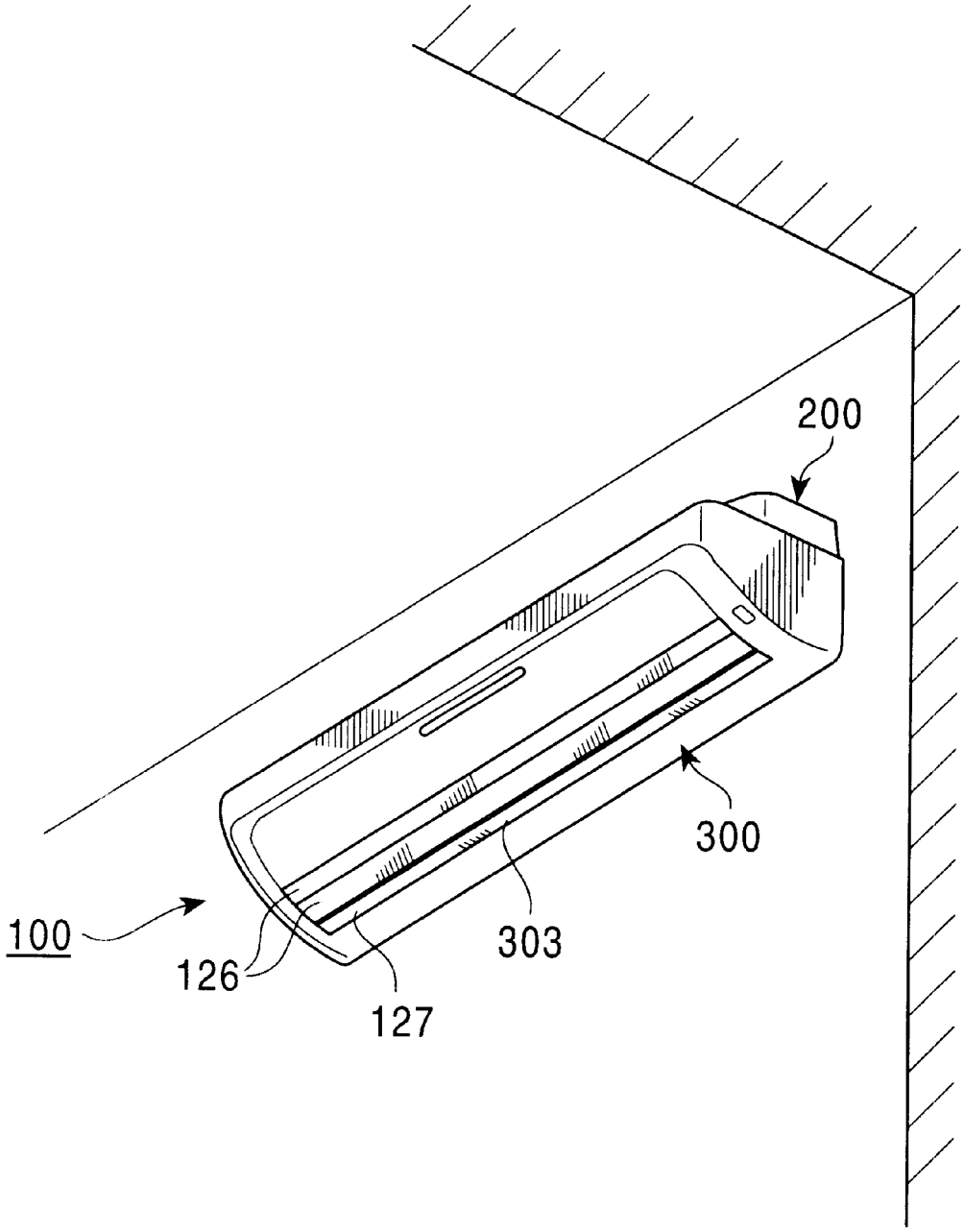
FIG. 1 is an appearance perspective view showing an air conditioner according to an embodiment of the present invention.
Figure 2:
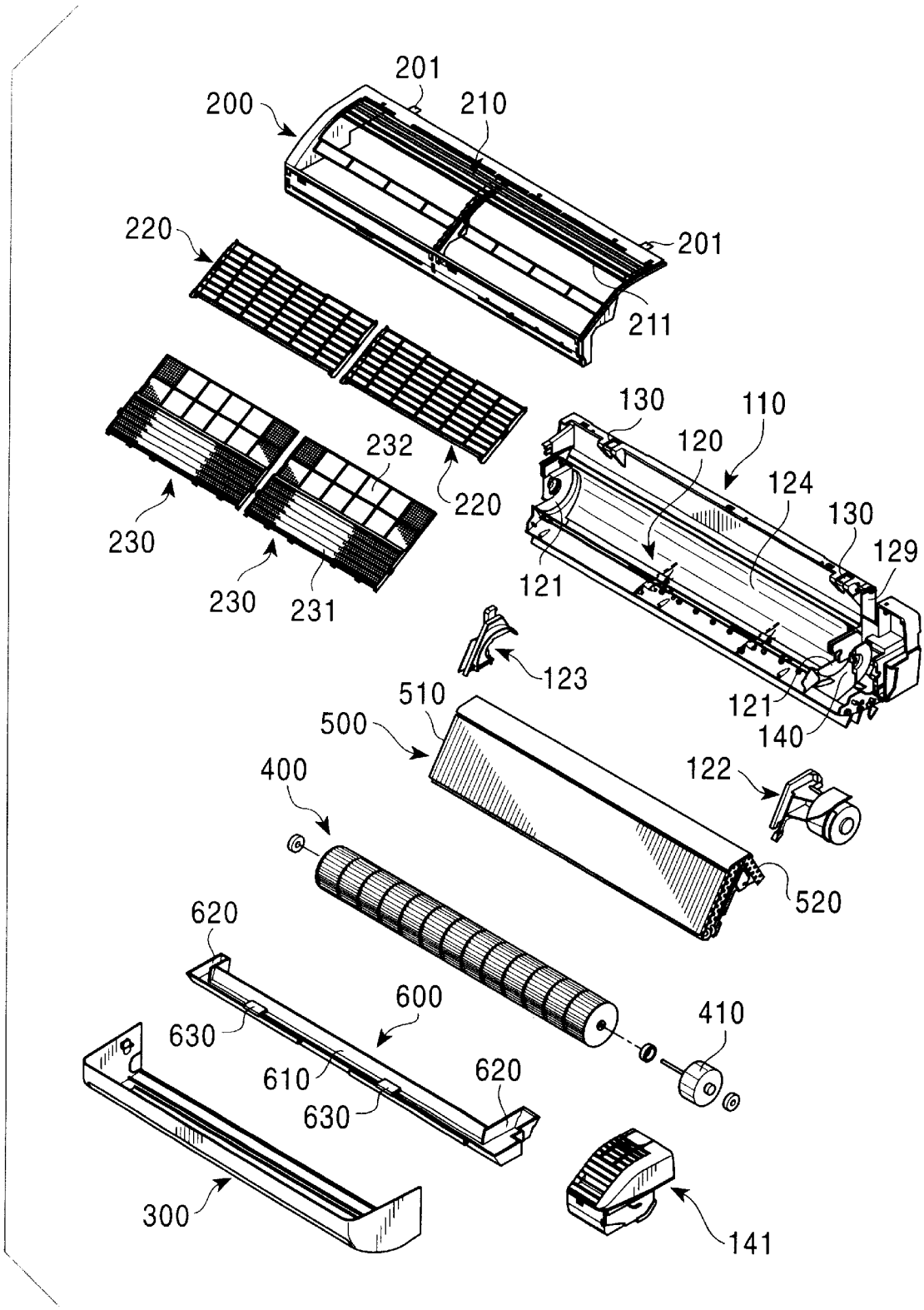
FIG. 2 is an exploded perspective view showing the air conditioner.

Next, with reference to the drawings, the description will be made of embodiments of the present invention. FIG. 1 is an appearance perspective view showing a body cabinet 100 which this air conditioner has, and FIG. 2 is an exploded perspective view showing the body cabinet 100 and various components installed therein.

The body cabinet 100 has: a base panel 110 to be fitted onto the wall surface through fittings (not shown); a top panel 200; and a front panel 300, and any of them is made of synthetic resin. Within the body cabinet 100, there are housed a cross flow fan 400, a heat exchanger 500, a drain pan 600 or the like.

Figure 3:
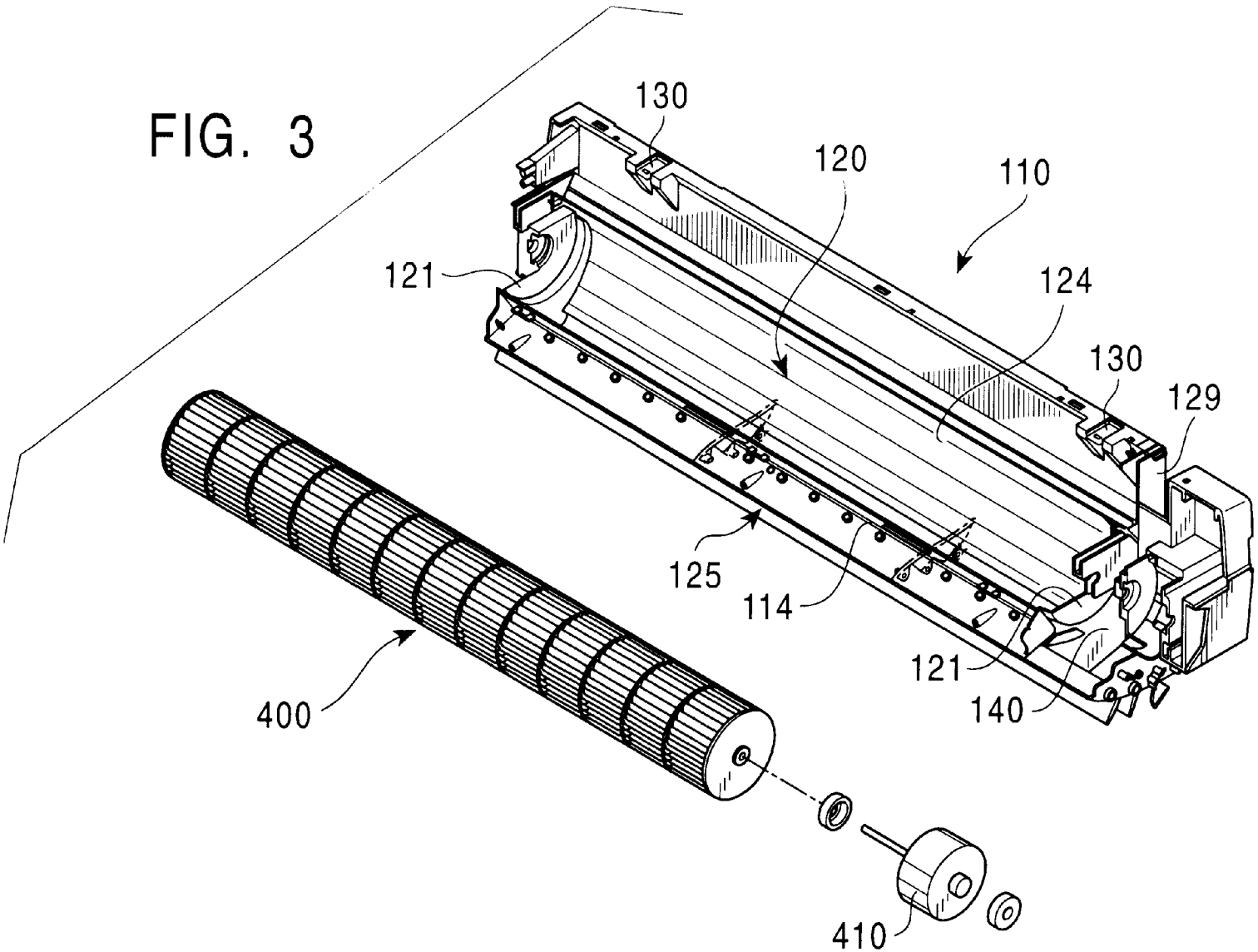
FIG. 3 is a perspective view showing a state in which a cross flow fan is mounted onto a base panel of the air conditioner.
Figure 4:
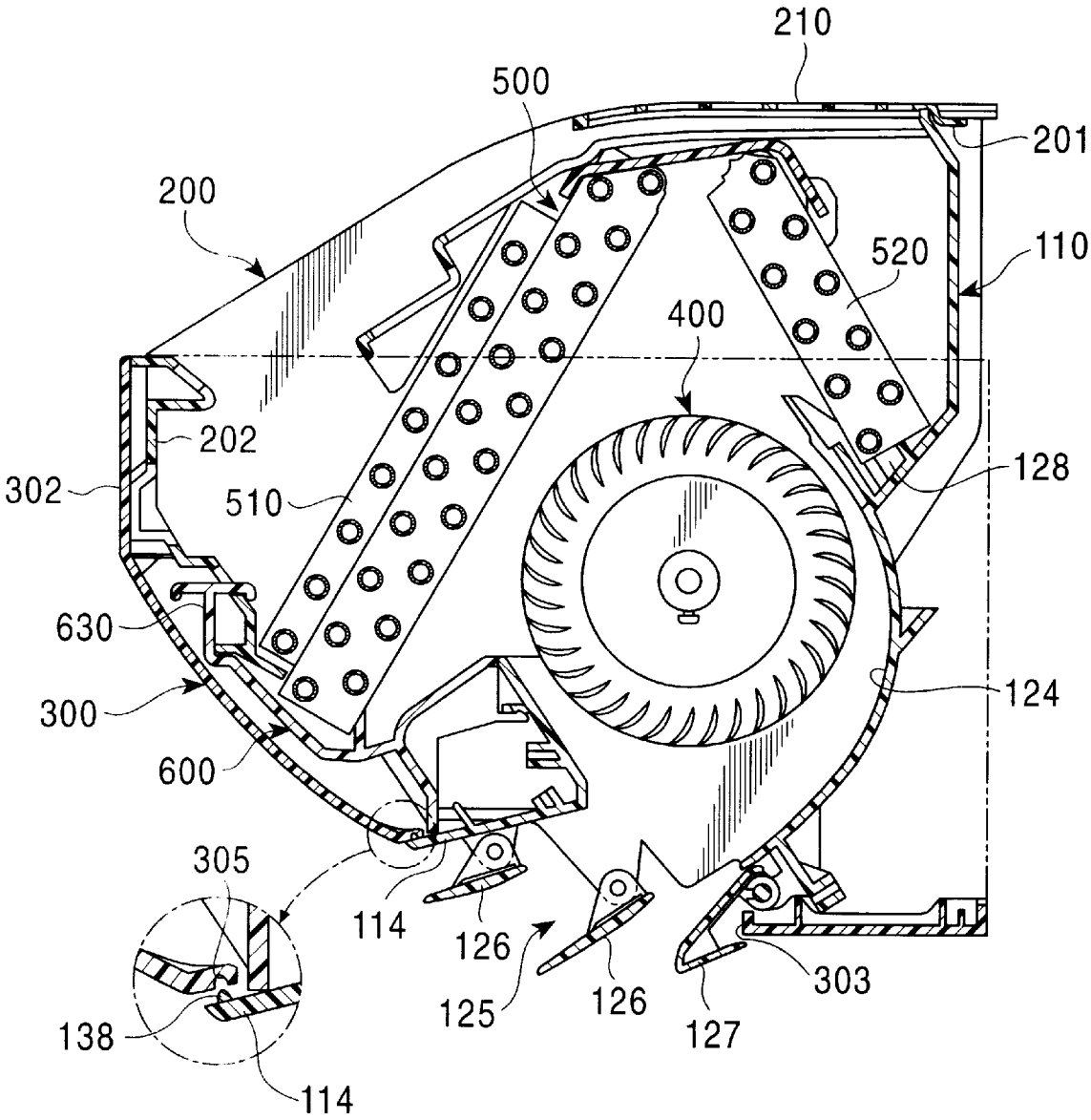
FIG. 4 is a sectional view showing a state in which no filter has been mounted onto the air conditioner.

Referring to the perspective view of FIG. 3 and a sectional view of FIG. 4 together, a major portion of the base panel 110 is occupied by a fan holder 120 to which the cross flow fan 400 is mounted, and sideways the fan holder 120, a box for electric 140 is formed. At both ends of the fan holder 120, there are provided bearing holders 121, 121, and the cross flow fan 400 is supported between the bearing holders 121, 121 through a radial bearing (not shown).

In the box for electric 140, there is housed a fan motor 410 for driving the cross flow fan 400. After the cross flow fan 400 and the fan motor 410 are mounted, the bearing holders 121, 121 are covered with bearing covers 122, 123. In this case, a bearing cover 123 on the box for electric 140 side is used also as a retainer cover for the fan motor 410.

A rear wall of the fan retainer 120 is formed into a circular arc surface as a rear air direction guide (rear-guide) 124. Also, a base panel 110 has a front air direction guide (front-guide) 114 to be arranged in front of a cross flow fan 400, and this front air direction guide 114 and a lower edge of the rear air direction guide 124 form an air outlet port 125.

This air outlet port 125 is provided with an air direction flap for changing the direction of a current of air to be blown from the cross flow fan 400 in an up-and-down direction, and a left-right air louver for changing in the lateral direction, but FIG. 4 shows only the air direction flap 126.

Also, at the rear edge of the air outlet port 125, there is pivotally provided a diffuser 127 continuing to the rear air direction guide 124. The diffuser 127 is driven by a motor (not shown), and is opened at maximum in a counter-clockwise direction in FIG. 4, for example, during quick heating or quick cooling.

Next, a heat exchanger 500 is mounted onto the base panel 110. In the present embodiment, the heat exchanger 500 includes two heat exchange units 510, 520 which have been combined in a substantially·(lambda) type, and is screwed to the base panel 110 so as to cover the cross flow fan 400.

The base panel 110 is formed with a drain pan 128 for a rear surface-side heat exchange unit 520. Refrigerant piping for the heat exchanger 500 is drawn out of a groove 129 formed at a position above the box for electric 140 of the base panel 110. Also, on the upper edge of the base panel 110, there is provided a latching hole 130 for latching the top panel 200. The latching hole 130 can be provided at least at one place each left and right.

Figure 5:
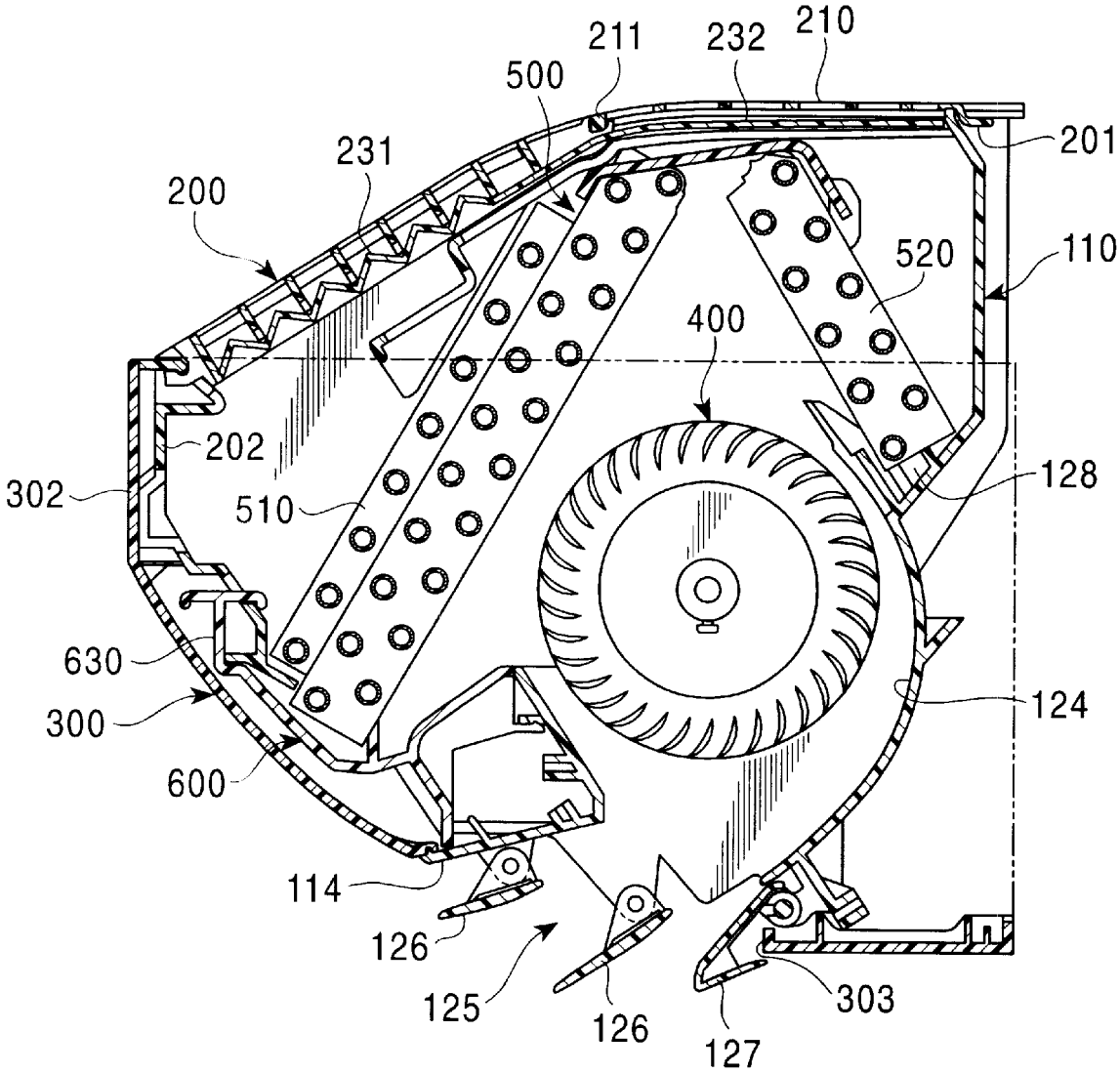
FIG. 5 is a sectional view showing a different portion from FIG. 4 in a state in which a filter has been mounted onto the air conditioner.

Next, the top panel 200 is mounted onto the base panel 110. Referring to the sectional views of FIGS. 2 and 5, a latching pawl 201 projecting from the rear end of the top panel 200 is inserted into the latching hole 130, and with the latching pawl 201 as a proximal end, the top panel 200 is mounted onto the base panel 110 so as to cover the heat exchanger 500.

Figure 9:
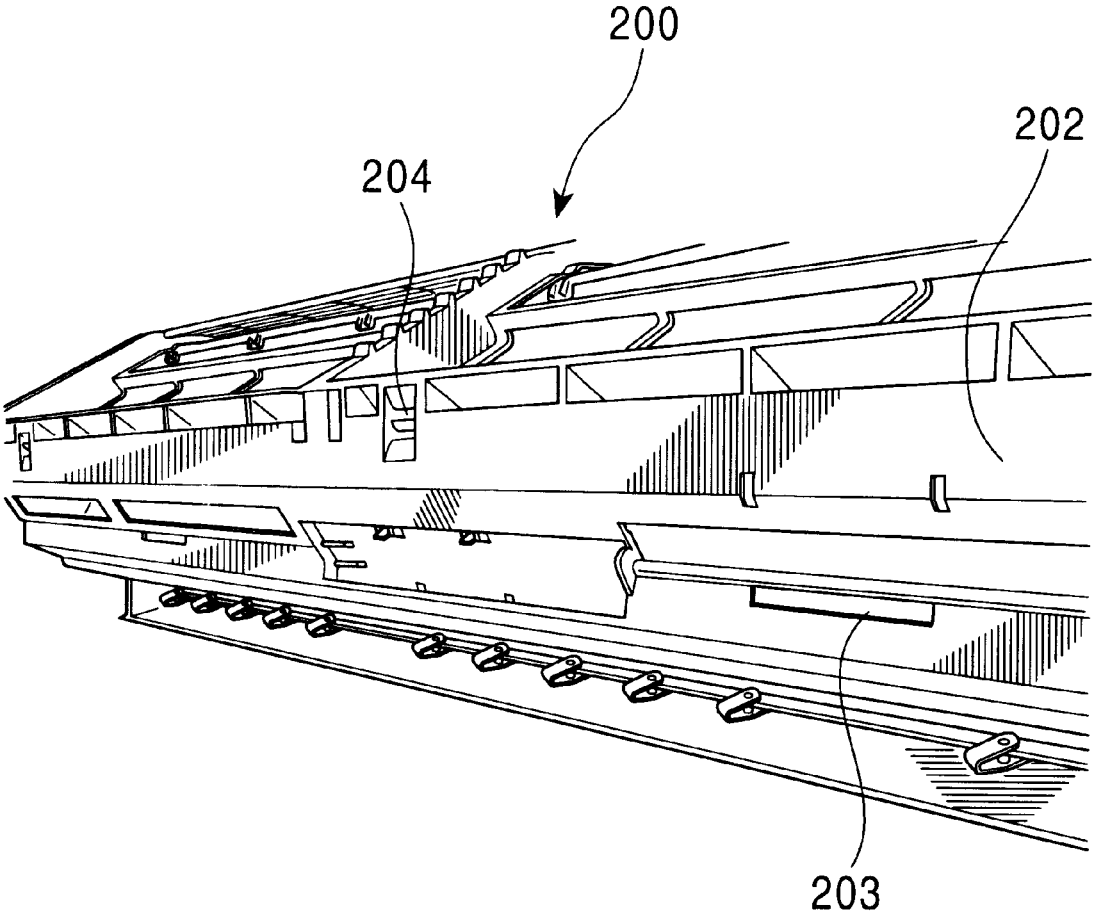
FIG. 9 is a perspective view showing a face plate of a top panel on the front end side in the air conditioner.

Referring to FIG. 9 together, on the side of the front end of the top panel 200, there is formed a face plate 202 extending to the lower end of the front surface-side heat exchange unit 510. On the side of the lower part of the face plate 202, there is formed a latching slit 203 for coupling to the drain pan 600, and on the side of the upper part, there is formed an elastically deformable first latching pawl 204 for fastening the front panel 300.

Referring to FIG. 2 again, on the top panel 200, an air inlet grille is provided over its entire surface, but in the present invention, the air inlet grille consists of a fixed grille 210 integrally formed on the side of the rear end (base panel 110 side) of the top panel 200, and a movable grille 220 detachably provided on the side of the front end of the top panel 200. The fixed grille 210 side of the top panel 200 is substantially parallel with the indoor ceiling surface, and the movable grille 220 side is inclined obliquely below.

The top panel 200 is provided with a filter 230, but in the present embodiment, the movable grille 220 and the filter 230 are arranged in groups of two respectively, and the filter 230 is held by each movable grille 220.

Figure 7:
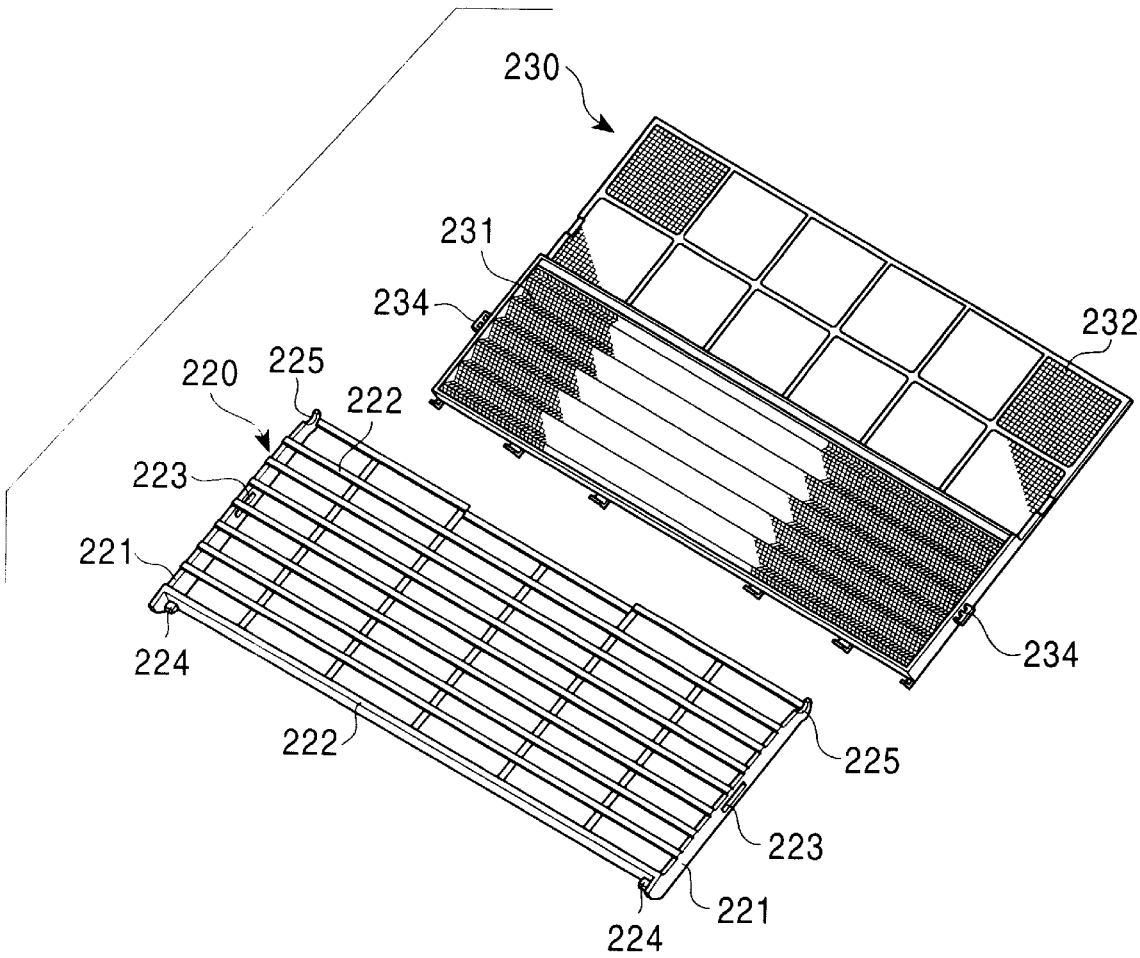
FIG. 7 is an exploded perspective view showing the movable grille and the filter separated.
Figure 8:
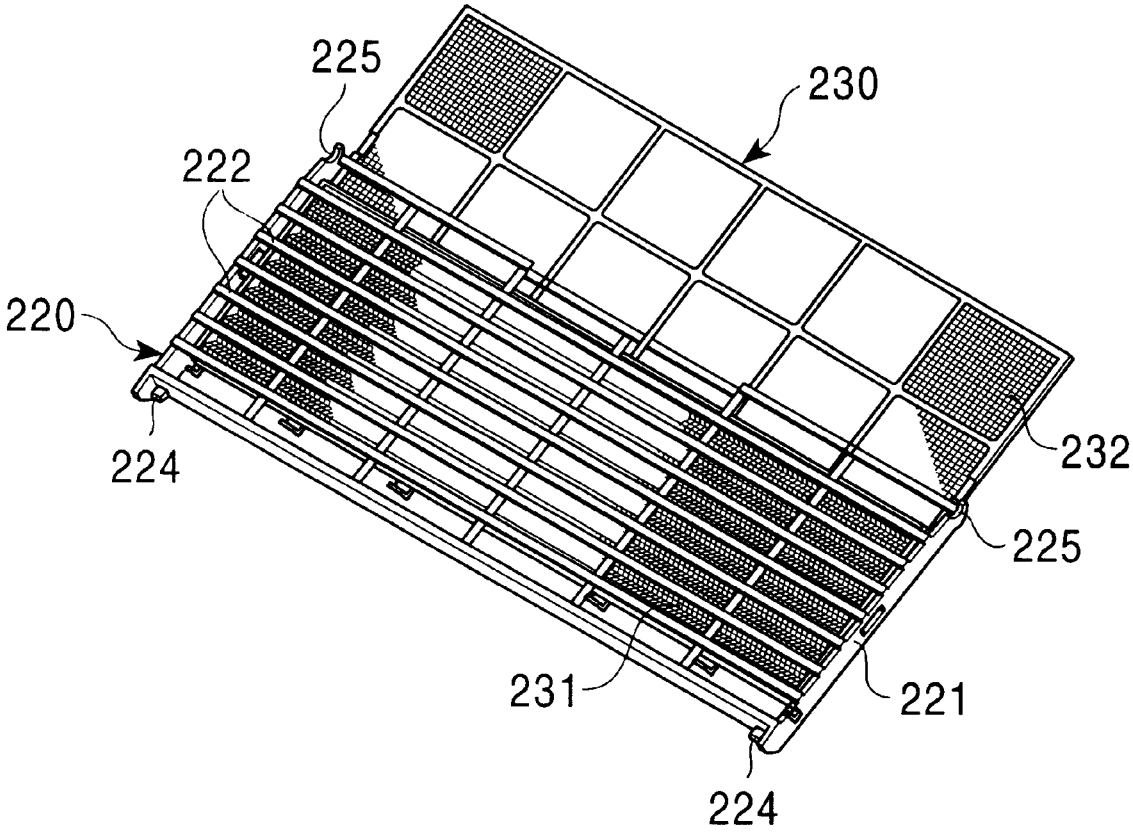
FIG. 8 is a perspective view showing a state in which the movable grille has been caused to hole the filter.
Figure 10:
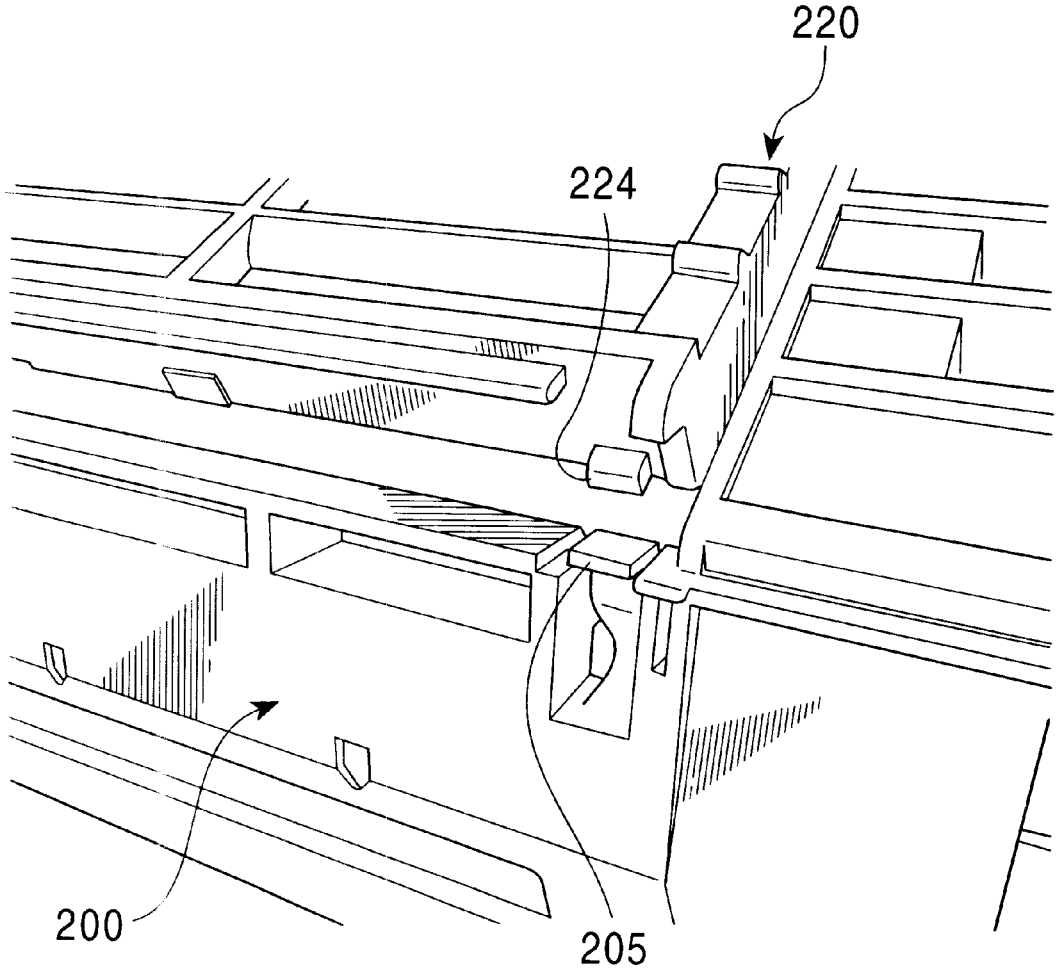
FIG. 10 is perspective view showing an engagement structure of the movable grille to the top panel.

With reference to FIGS. 7 and 8, the description will be made of one of them. The movable grille 220 has a plurality of frames 222 spanned across a pair of left and right side plates 221, and each side plate 221 is formed with a slit-shaped filter holder 223. Also, at the front end of each side plate 221, a latching projection 224 is formed, and correspondingly thereto, the top panel 200 is provided with an elastically deformable second latching pawl 205, which serves as the other party of the latching projection 224 (See FIG. 10).

Figure 6:
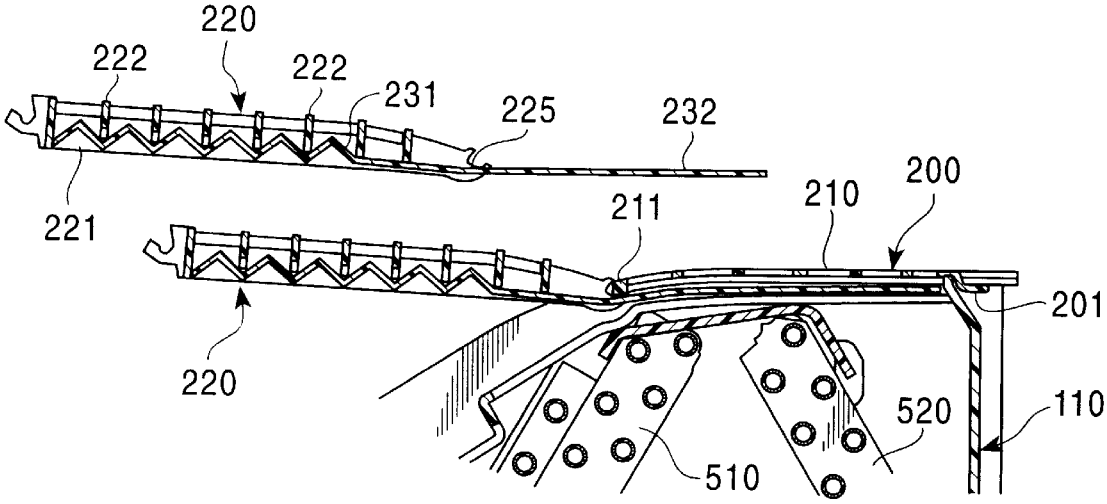
FIG. 6 is a sectional view showing a state in which a movable grille is mounted onto the air conditioner.
Figure 11:
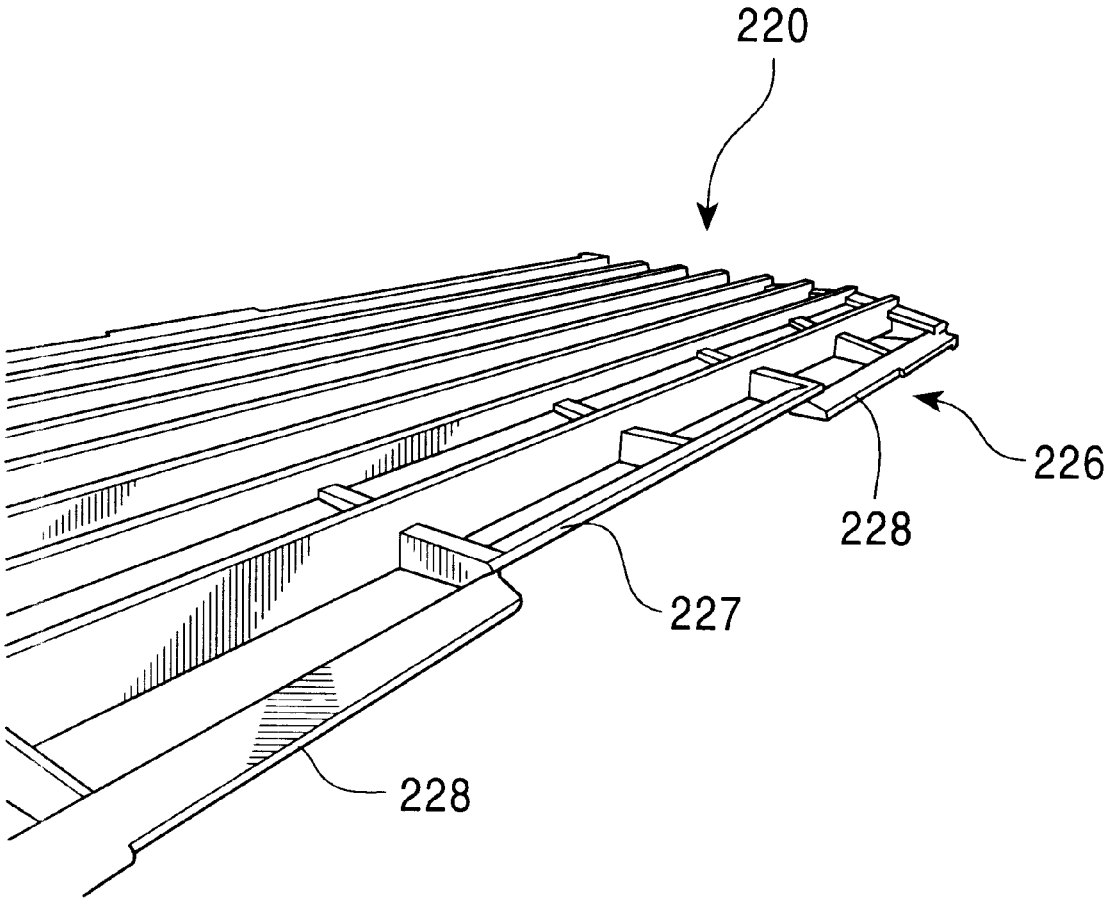
FIG. 11 is a perspective view showing structure of the movable grille on a rear end side.

As shown also in FIG. 6, at the rear end of each side plate 221, there is formed a substantially U-character shaped bearing fitting channel 225 which is rotatable, and attachable to or detachable from a front end frame 211 of the fixed grille 210. Also, as shown in FIG. 11, on the side of the rear end of the movable grille 220, there is provided a grille retainer 226 to the front end frame 211 of the fixed grille 210.

In the present embodiment, the grille retainer 226 includes a first retainer 227 inclined obliquely upwardly so as to abut against the top end edge of the front end frame 211, and a second retainer 228 inclined obliquely downward so as to abut against the lower end edge of the front end frame 211. The first retainer 227 is arranged at the center of the rear end of the movable grille 220, and the second retainer 228 each is arranged on both sides of the first retainer 227. This arrangement prevents the front end frame 211 from lifting.

Referring to FIGS. 7 and 8 again, the filter 230 has a corrugated filter 231 and a plane filter 232 provided contiguously to the side of the rear end of the same corrugated filter 231. The corrugated filter 231 is held by the movable grille 220, and the plane filter 232 is arranged below the fixed grille 210.

The reason why the plane filter 232 has been used as the filter for the fixed grille 210 is that the height dimension of the body cabinet 100 is reduced. The corrugated filter 231 has pawl pieces 234 at its left and right filter frames, and this pawl piece 234 is hung on the filter holder 223, whereby the corrugated filter 231 is held by the movable grille 220.

Referring to FIG. 6, in order to set the filter 230 at the top panel 200, the plane filter 232 is inserted below the fixed grille 210; thereafter, the bearing fitting channel 225 of the movable grille 220 is hung on the front end frame 211 of the fixed grille 210; and with the front end frame 211 as a proximal end, the movable grille 220 is closed to cause an engagement projection 224 to engage with a second latching pawl 205 on the top panel 200 side. In order to remove the filter 230, the movable grille 220 can be opened to draw out the entire movable grille 220.

Figure 12:
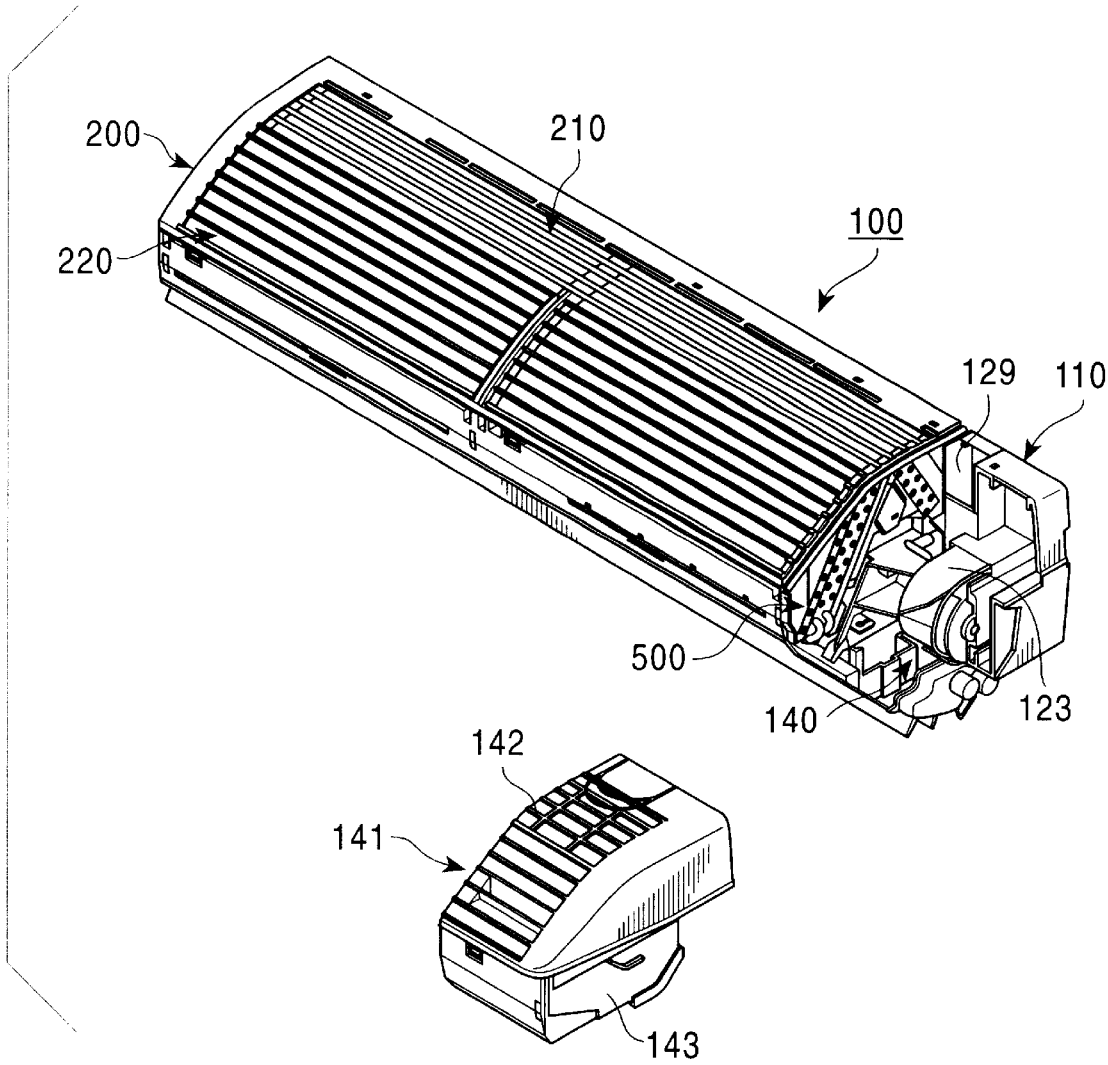
FIG. 12 is a perspective view showing a state of a service cover fitted to the air conditioner.

Next, as shown in FIG. 12, the box for electric 140 of the base panel 110 is covered with a service cover 141. A top surface 142 of this service cover 141 is coordinated with the top panel 200 in design, and constitutes a portion of the top panel 200 in appearance. Also, a side surface 142 of the service cover 141 actually becomes one side surface of the base panel 110.

Although not shown, the service cover 141 is mounted onto the base panel 110 by means of screw, latching pawl or the like. In this respect, an order of installing the service cover 141 onto the base panel 110 may be before or after the top panel 200.

Figure 13:
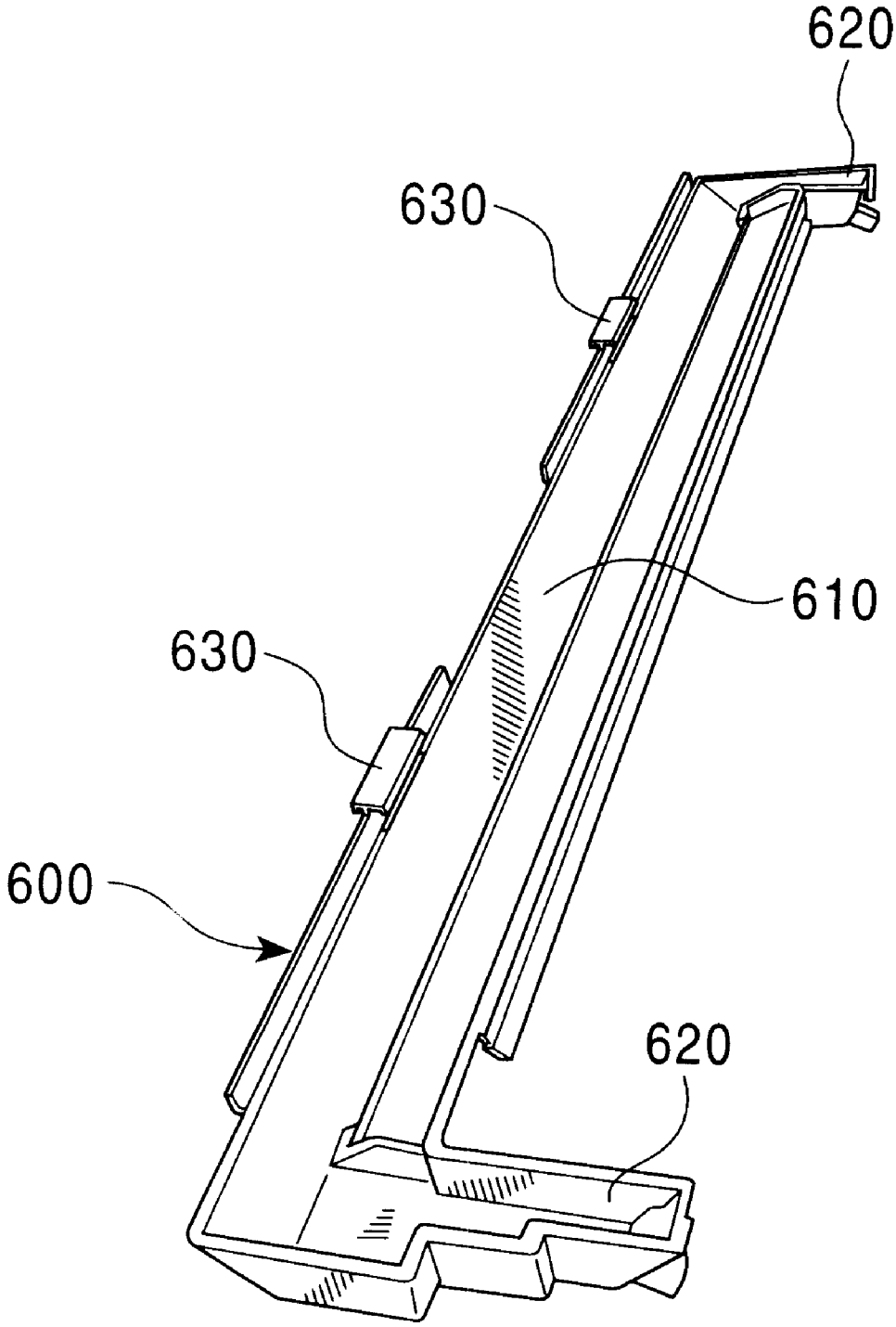
FIG. 13 is a perspective view showing a drain pan of the air conditioner.

Next, a drain pan 600 is mounted onto the base panel 110 so as to apply the drain pan 600 to the lower end of a front surface-side heat exchange unit 510. As shown in FIG. 13, the drain pan 600 includes: a gutter-shaped drain pan body 610 extending in a straight line along the lower end of the front surface-side heat exchange unit 510; and a pair of left and right mounts for drain pan 620 bent at substantially right angles toward the base panel 110 side from the both ends, and is attachable to or detachable from the base panel 110. In this respect, the mounts for drain pan 620 are formed with drainage holes although not shown.

Figure 14:
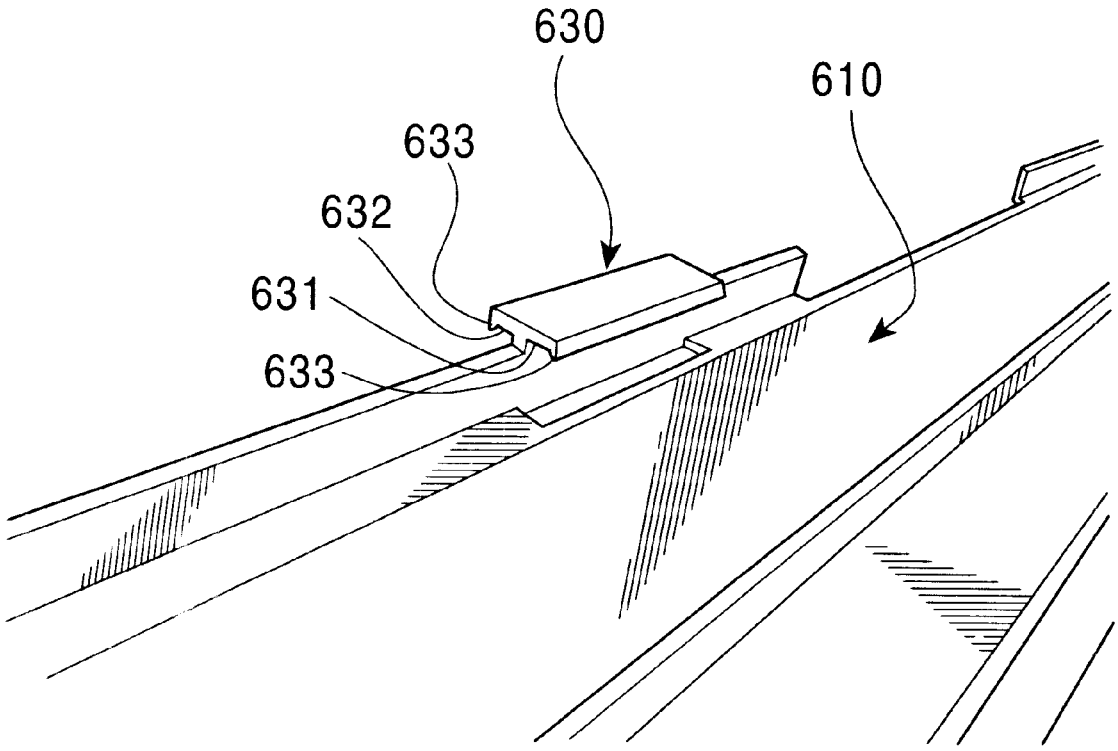
FIG. 14 is an enlarged perspective view showing a latching pawl of the drain pan.

As shown enlarged in FIG. 14, at the front edge of the drain pan body 610, there is formed a latching pawl 630 to be latched in a latching slit 203 (See FIG. 9) on the top panel 200 side. This latching pawl 630 is shaped like a T-character in cross section, is rocking-deformable like seesaw and has a hook 633 in each of its edges 631, 632.

Figure 15:
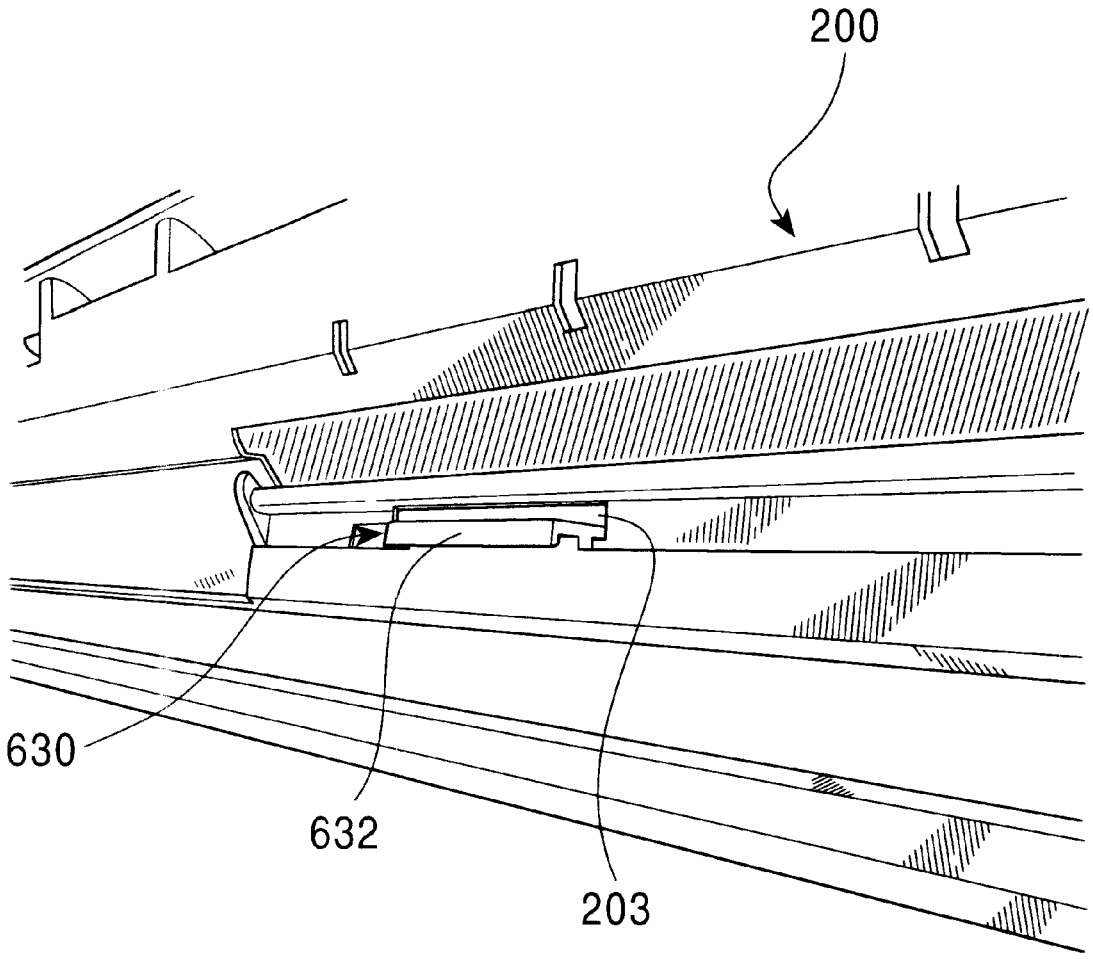
FIG. 15 is a perspective view showing a state in which the drain pan and the top panel are coupled together.

The drain pan 600 is pressed into the base panel 110, whereby each tip end of its mounts for drain pan 620, 620 is captured by a receiving groove (not shown) provided on the base panel 110 side, the drain pan body 610 is placed on the front air direction guide 114, and a latching pawl 630 is latched in a latching slit 203. Its latching state is shown in FIG. 15.

As seen from this figure, one edge 631 of the latching pawl 630 enters the latching slit 203, and the other edge 632 side is located in the outside of the latching slit 203. Accordingly, during maintenance such as cleaning, the other edge 632 is pressed down, whereby the latching pawl 630 is disengaged from the latching slit 203 and the drain pan 600 can be easily drawn out of the base panel 110. In this respect, in the present embodiment, each of the edges 631, 632 has a hook 633, but the hook 633 on the other edge 632 side which has nothing to do with latching may be omitted.

Figure 16:
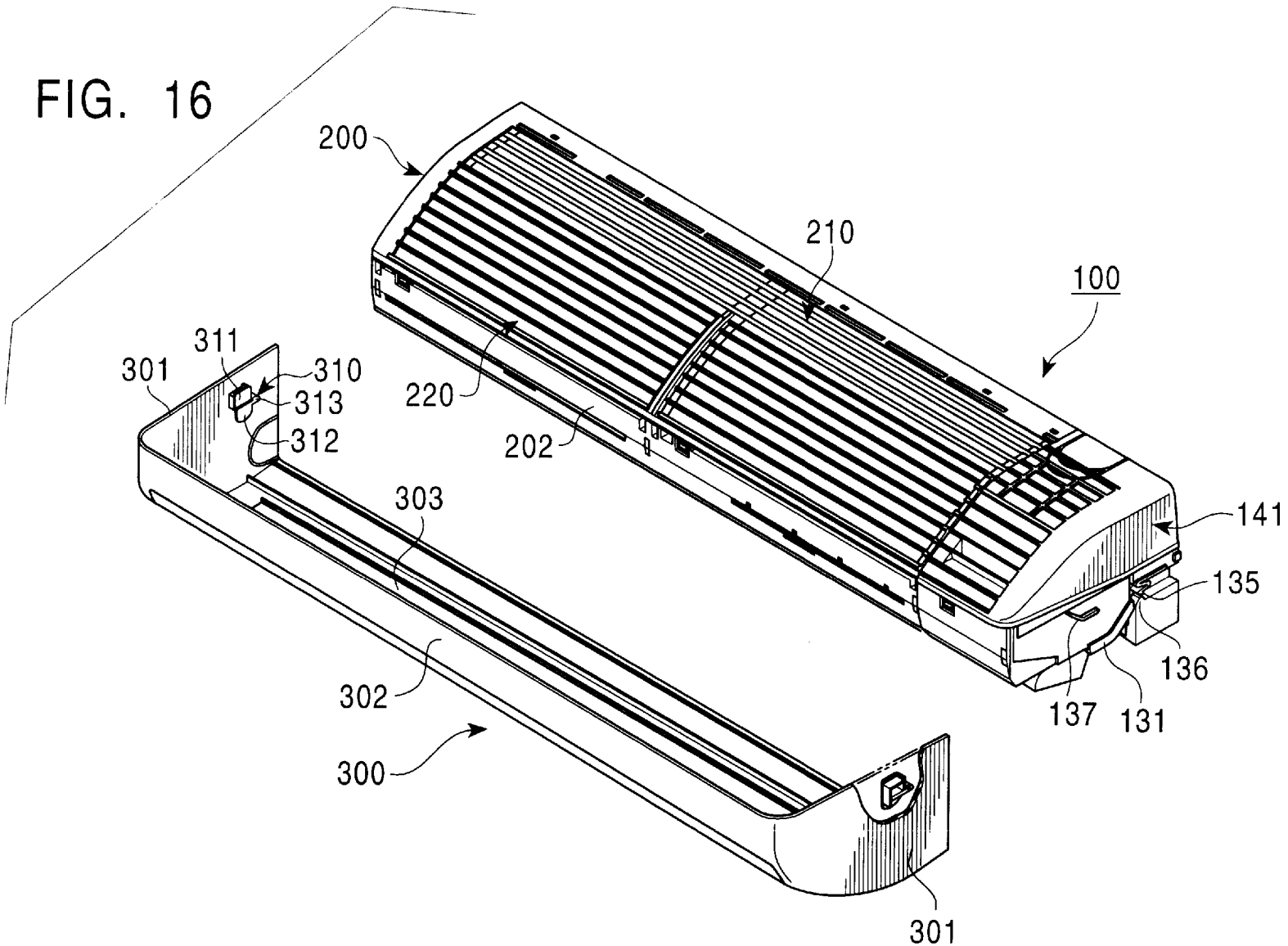
FIG. 16 is a perspective view showing a state in which the front panel is fitted onto the base panel in the embodiment.

Next, the front panel 300 is mounted onto the base panel 110. As shown in FIG. 16, the front panel 300 includes a pair of left and right side plates 301 formed so as to cover both side walls of the base panel 110, and the front end 302 side is formed like a ship bottom in cross section which is curved upwardly from the base panel 110 side.

The front panel 300 has only an air outlet port 303 which coincides with an air outlet port 125 of the base panel 110 formed on its rear end side, and has no seam at all when viewed from the floor surface side.

On each side wall of the base panel 110, there is provided a front panel guide 131 for guiding the front panel 300 to the latching position, and on the inner surface of each side plate 301 of the front panel 300, there is formed a hook 310 capable of sliding along the front panel guide 131.

Figure 17:
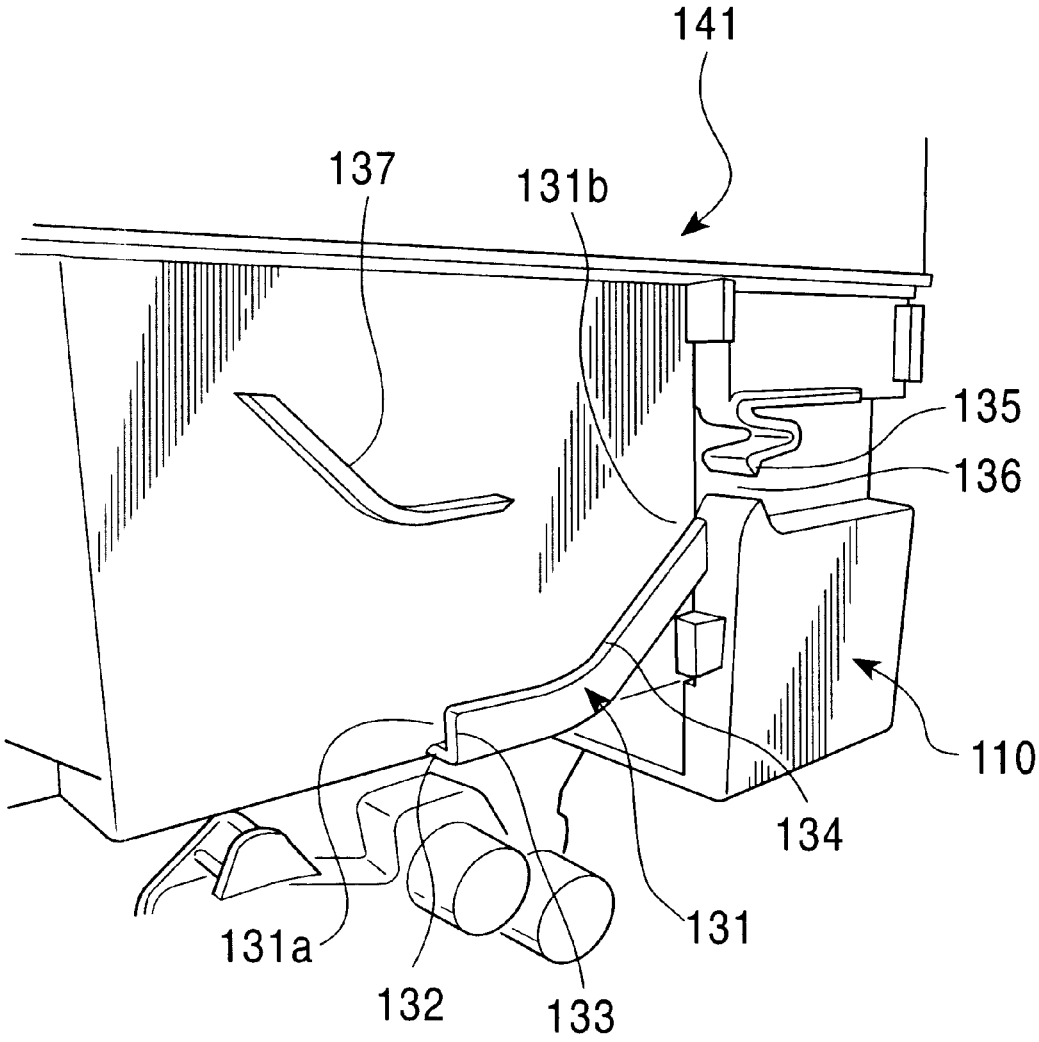
FIG. 17 is a perspective view showing a structure of a side wall of the base panel.

Referring to FIG. 17 together, at the latching position of the base panel 110, there is provided a latching channel 136 having an elastically deformable latching pawl 135. In this respect, the side wall of the base panel 110 shown in FIGS. 16 and 17 is actually provided by the service cover 141. Although not shown, also on the side wall of the base panel 110 on the opposite side, there are similarly formed a front panel guide 131 and a latching channel 136 having an elastically deformable latching pawl 135.

In the present embodiment, the front end 131*a* of the front panel guide 131 on the anti-base panel side is arranged at a lower position near the indoor floor surface than the position of the latching channel 136, and between the front end 131*a* and the rear end 131*b* of the front panel guide 131, there is provided a slope 134 at a predetermined angle.

Figure 18:
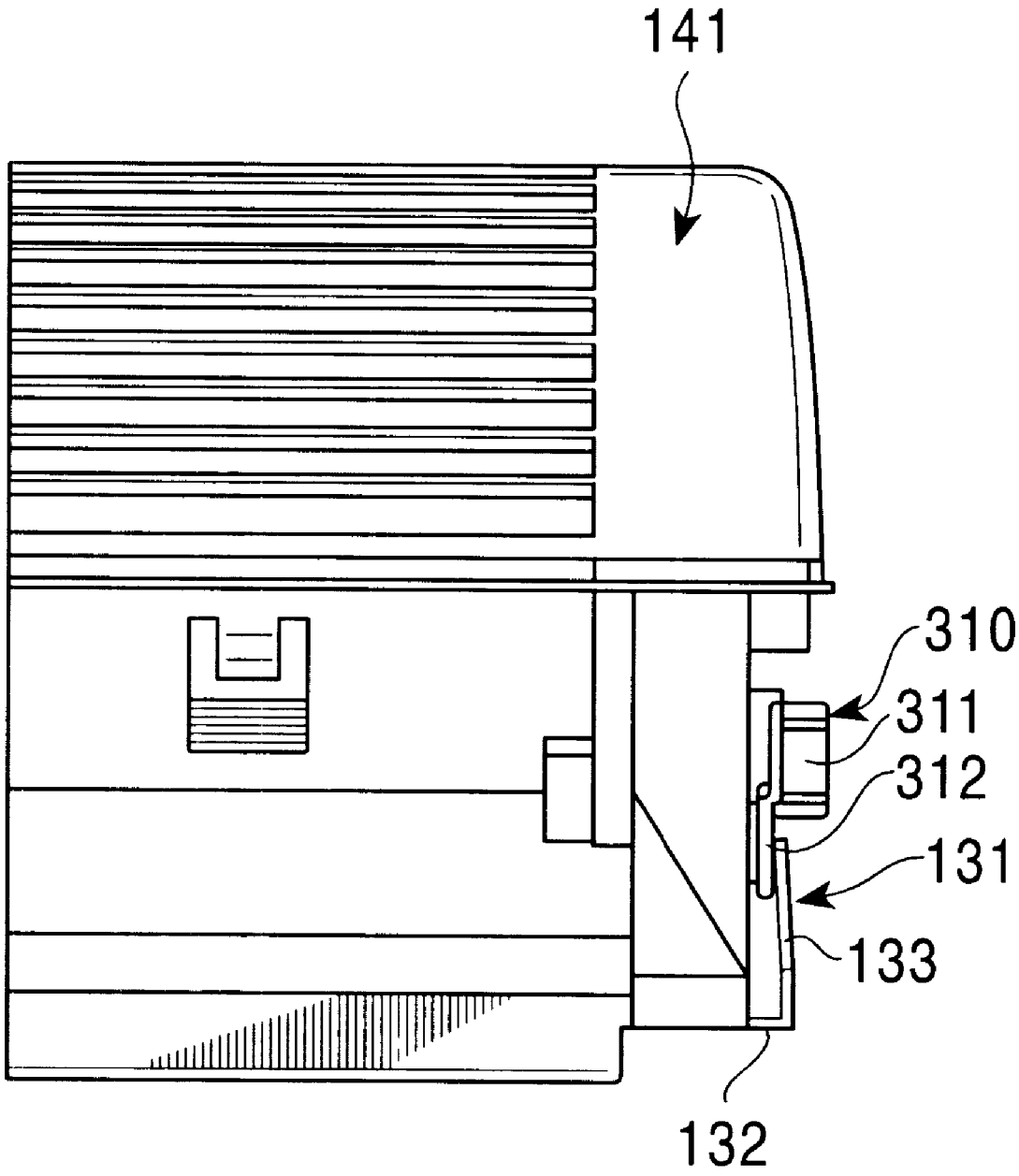
FIG. 18 is a sectional view for explaining a structure of a front panel guide provided on the base panel.

As clearly shown in FIG. 18, the front panel guide 131 is constructed as an L-character shaped body in cross section including: a base plate 132 substantially perpendicular to the side wall; and a guide plate 133, which is bent substantially at right angles upwardly from the base plate 132 and forms a guide groove with the side wall.

Also, the guide plate 133 is formed such that the groove width of the guide groove is wide on its front end 131*a* side, and becomes gradually narrower toward the rear end 131*b* side. Further, on the side wall of the base panel 110, there is provided a restriction guider 137 for preventing the front panel 300 from being lifted higher than a predetermined height position when placing the hook 310 on the front panel guide 131.

Figure 19:
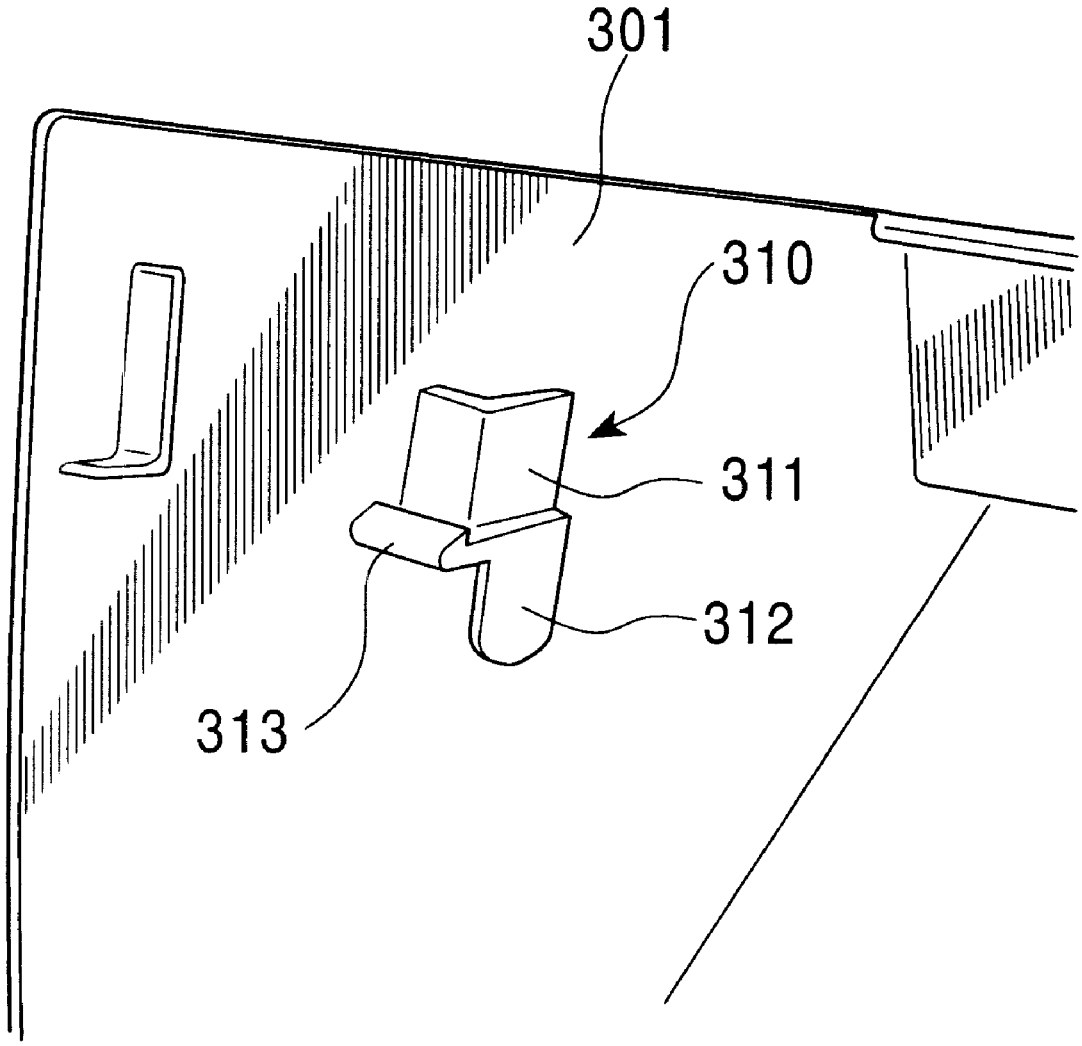
FIG. 19 is a perspective view showing a hook provided on the front panel of the air conditioner.

Referring to FIG. 19, the hook 310 on the front panel 300 side has: a hook body 311 formed into a block shape to be placed on the top end of the guide plate 133; an engagement rib 312 bent downward from the hook body 311 so as to enter the guide groove; and a latching projection 313 projecting from the hook body 311 toward the base panel 110 side.

Figure 20:
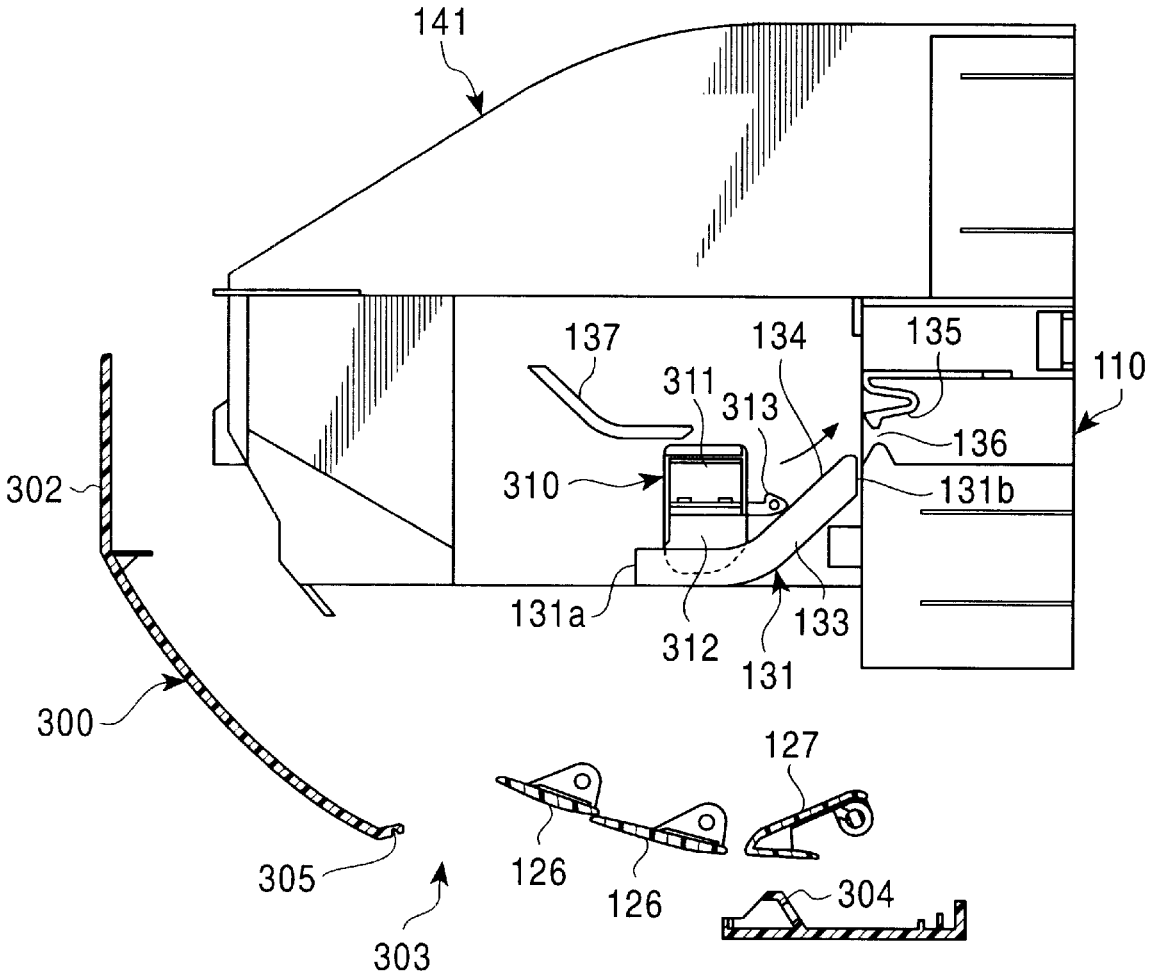
FIG. 20 is a side view for explaining the procedure for fitting the front panel onto the base panel.

Next, the description will be made of a procedure for mounting the front panel 300. First, as shown in FIG. 20, the front panel 300 is lifted up to place the hook 310 on the front panel guide 131, and then the engagement rib 312 is inserted into the guide groove. At this time, since the restriction guider 137 prevents the panel from being lifted further higher than it, the front panel 300 is prevented from bumping against the air direction flap 126, the diffuser 127 or the like.

Figure 21:
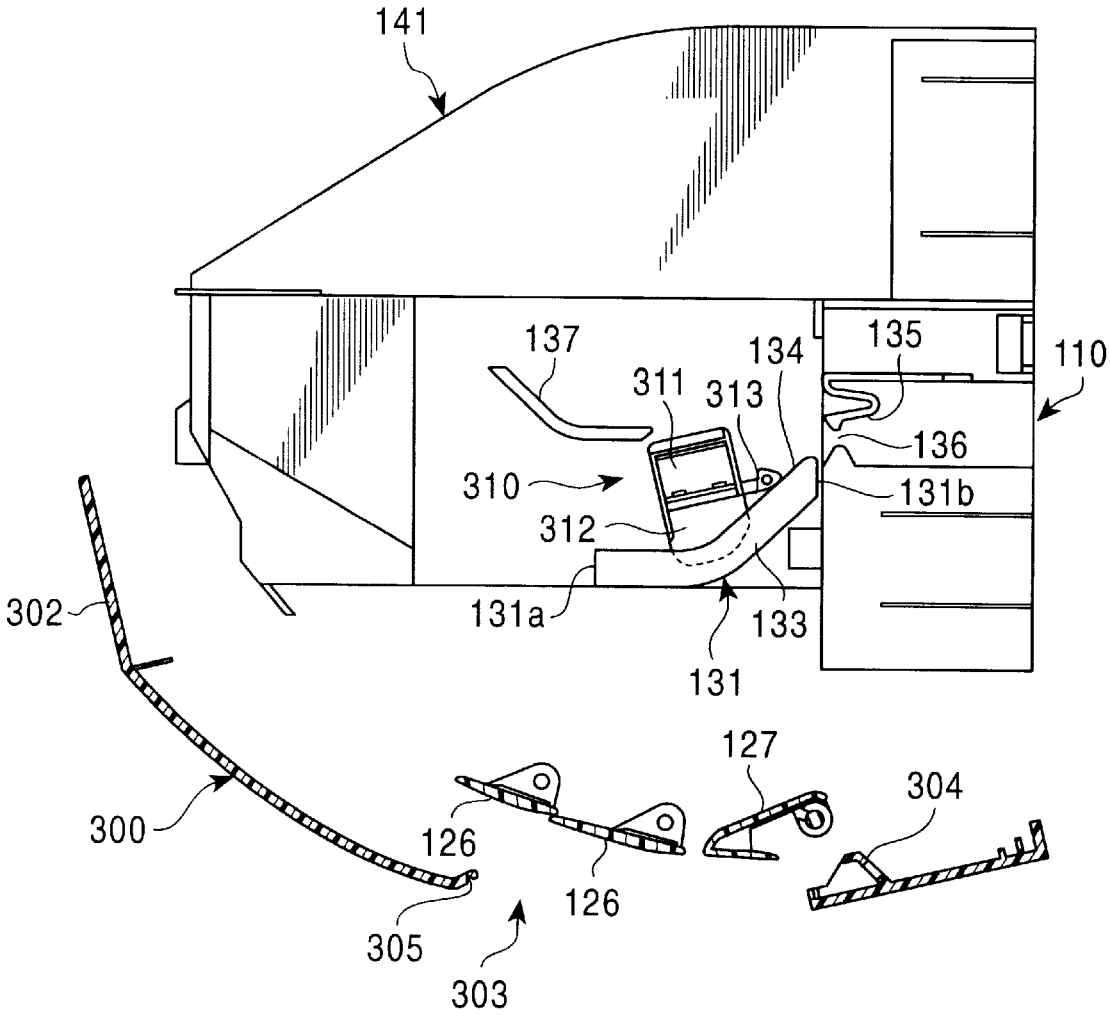
FIG. 21 is a side view for explaining the procedure for fitting the front panel onto the base panel.
Figure 22:
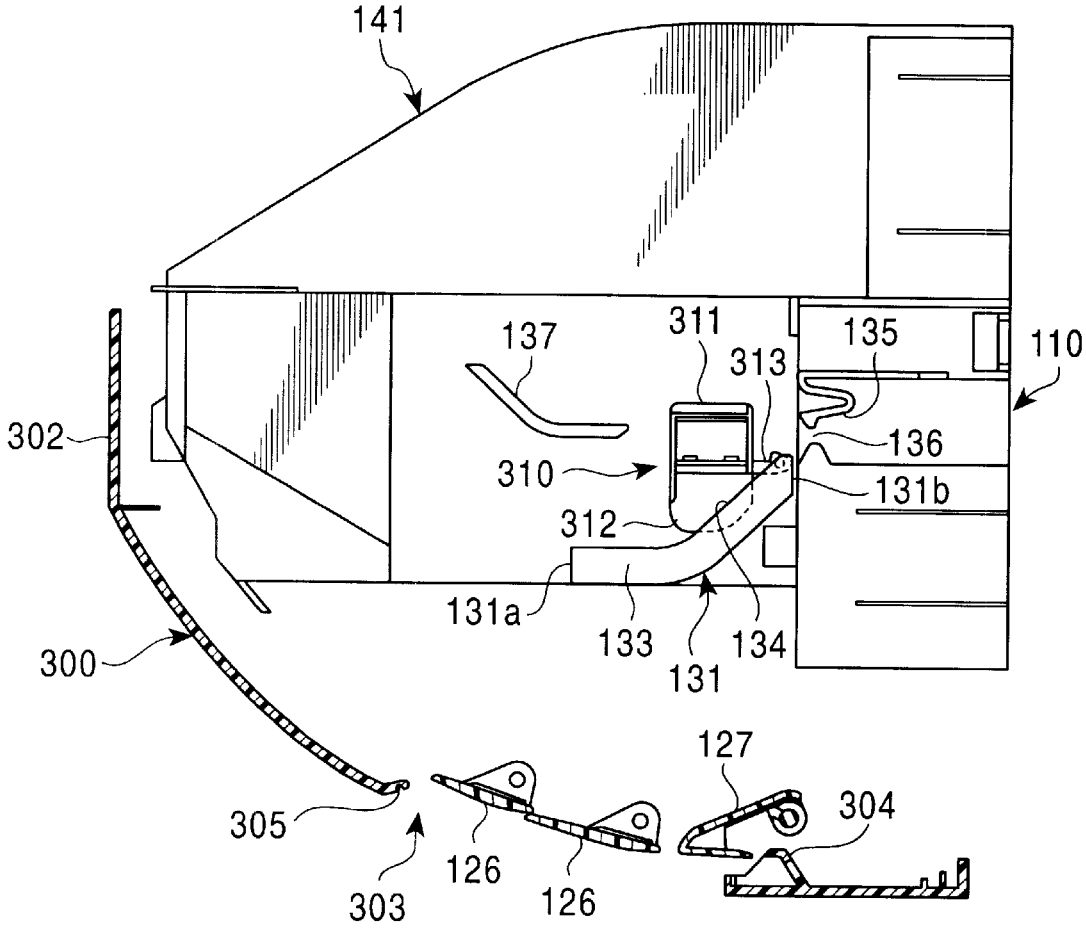
FIG. 22 is a side view for explaining the procedure for fitting the front panel onto the base panel.

Thus, when the front panel 300 is pressed in toward the base panel 110, the latching projection 313 of the hook 310 mounts on the slope 134 of the front panel guide 131 as shown in FIG. 21, and therefore, after the entire front panel 300 is inclined once, the latching projection 313 is conducted by the latching channel 136 to be finally captured by the latching pawl 132 as shown in FIG. 22.

Since in this sliding process of the hook 310, the groove width of the front panel guide 131 becomes gradually narrower, both side plates 301 of the front panel 300 are drawn toward the side of the side walls of the base panel 110. Thereby, the front panel 300 is prevented from being opened.

Also, as shown in FIG. 22, on the inner surface of the front panel 300 on the rear end side, there is provided a boss 304 for screwing to the base panel 110. This boss 304 is provided with an inclined plane which inclines toward the anti-base panel side. Even if the boss 304 abuts against the air direction flap 126, the diffuser 127 or the like when mounting the panel, the inclined plane prevents the boss 304 from being caught in them.

Figure 23:
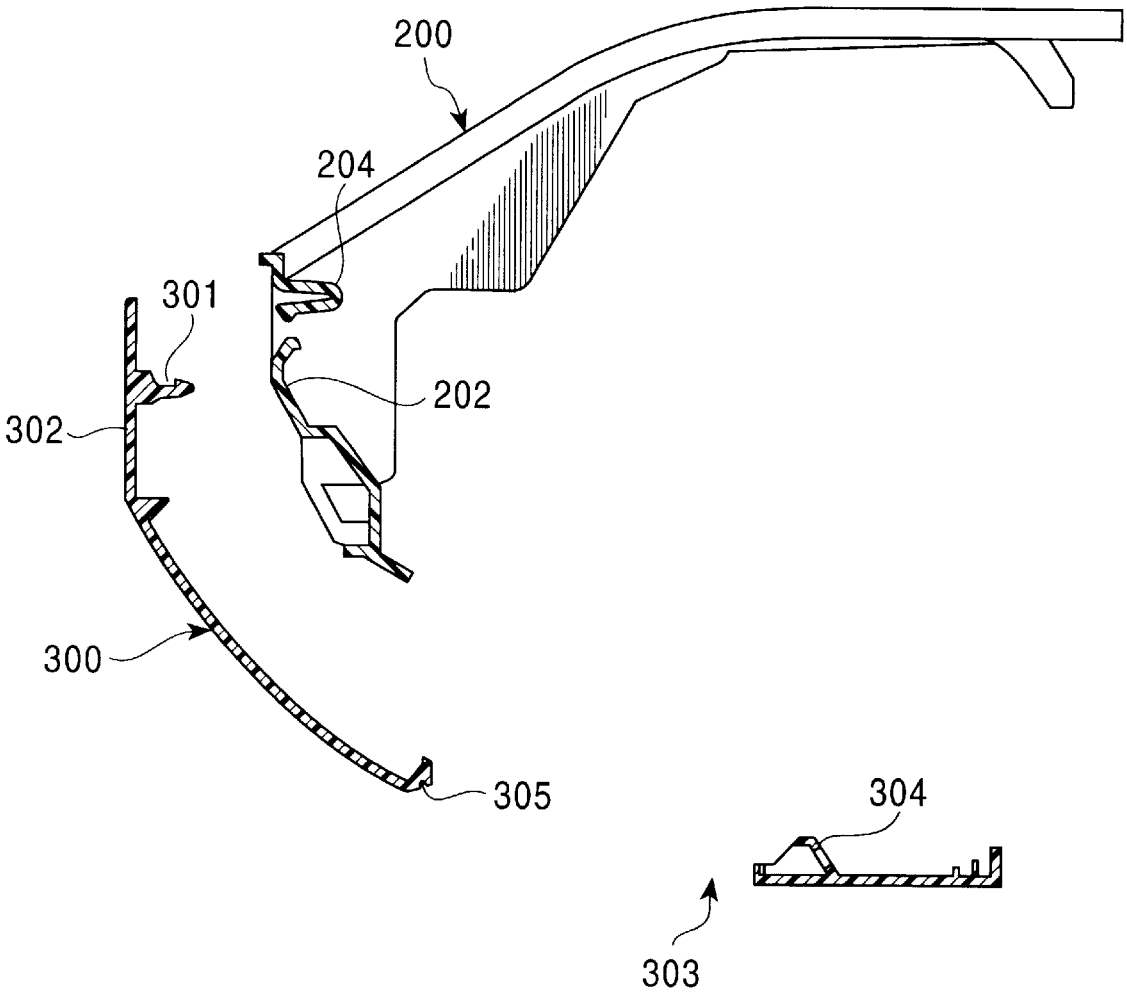
FIG. 23 is a sectional view for explaining a coupled state between the front panel and the top panel.
Figure 24:
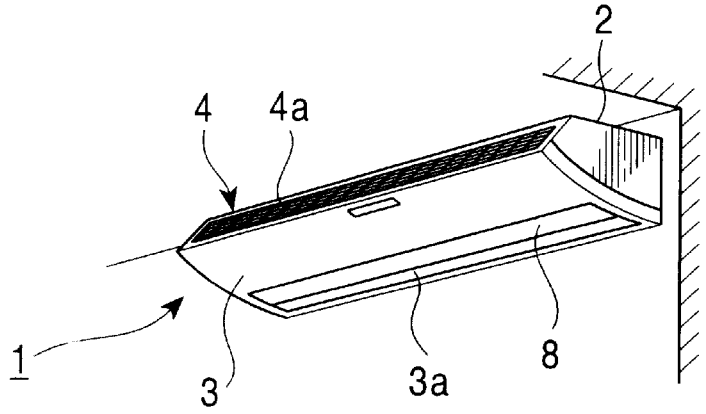
FIG. 24 PRIOR ART
FIG. 24 is an appearance perspective view showing a conventional air conditioner.
Figure 25:
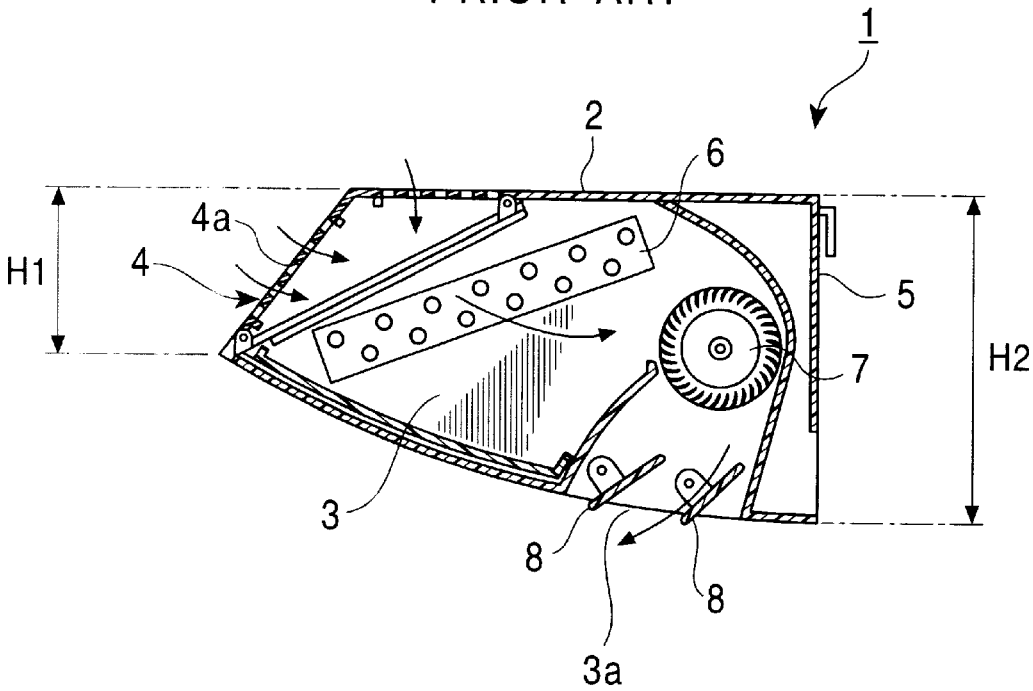
FIG. 25 PRIOR ART
FIG. 25 is a sectional view showing an internal structure of the conventional air conditioner.

Referring to FIG. 23, in order to prevent the front panel 300 from being opened on the front end 302 side, on the inner surface side of the front end 302, there is provided an engagement projection 301 for being captured by a first latching pawl 204 provided on the top panel 200 side.

Also, in order to enhance stiffness of the front panel 300, the front air direction guide 114, which forms an air outlet port 125 of the base panel 110, is provided with an engagement rib 138 as shown in FIG. 4, and correspondingly thereto, at the edge of an air outlet port 303 of the front panel 300, there is formed an engagement slit 305 as the other party of the engagement rib 138.

The present invention is suitable for a large-sized air conditioner with wide width, but is not limited thereto. Also, the order of mounting (assembling) each member is not limited to the order of the description in the above described embodiment.

In the foregoing, the detailed description has been made of the present invention with reference to the specific aspect, but within the scope of the present invention specified in claims, there should be included changes, modifications and equivalent techniques that those skilled in the art who have understood the above described contents can easily perform.

What is claimed is:

1. An air conditioner having a body cabinet, comprising:

a base panel to be fixed to an indoor wall surface through predetermined fixing means;

a front panel formed like a ship bottom in cross section such that a rear end thereof is latched to a lower end of said base panel and a front end side curves upwardly; and a top panel, the rear end of which is latched to a top end of said base panel and the front end of which is butted against the front end of said front panel, in which on said base panel, a cross flow fan and a box for electric are arranged side by side, and a heat exchanger and a drain pan are mounted; on the side of the rear end of said front panel, there is provided an air outlet port; and said top panel is provided with an air inlet grille having a filter, characterized in that the front end of said top panel is fixed to said drain pan.

2. The air conditioner according to claim 1, characterized in that on the side of the front end of said top panel, there is formed a latching slit; on said drain pan side, there is provided a latching pawl; and the front end of said top panel is fixed to said drain pan by means of said latching slit and said latching pawl.

3. The air conditioner according to claim 2, characterized in that said latching pawl is shaped like a T-character in cross section; at least on one edge thereof, a pawl to be latched within said latching slit is formed; the other edge thereof is located in the outside of said latching slit as a latch-releasing one; and said latching pawl is rock-able like seesaw.

4. The air conditioner according to claim 1, characterized in that said drain pan is attachable to or detachable from said base panel.

5. The air conditioner according to claim 4, characterized in that said drain pan includes a drain pan body to be arranged along the lower end of said heat exchanger and mounts for drain pan formed at both ends thereof; said drain pan body is supported by a front air direction guide of said base panel; and said mounts for drain pan are fitted and held in a predetermined position of said base panel.

6. The air conditioner according to claim 1, characterized in that said box for electric is detachably provided with a service cover constituting one each of said top panel and said base panel respectively in appearance.

7. The air conditioner according to claim 1, characterized in that at a rear end edge of said air outlet port, there is pivotally provided a diffuser continuing to the rear air direction guide of said base panel.

8. An air conditioner having a body cabinet, comprising:

a base panel to be fixed to an indoor wall surface through predetermined fixing means;

a front panel formed like a ship bottom in cross section such that a rear end thereof is latched to a lower end of said base panel and a front end side curves upwardly; and a top panel, the rear end of which is latched to a top end of said base panel and the front end of which is butted against the front end of said front panel, in which on said base panel, a cross flow fan and a box for electric are arranged side by side, and a heat exchanger and a drain pan are mounted; on the side of the rear end of said front panel, there is provided an air outlet port; and said top panel is provided with an air inlet grille having a filter, characterized in that said air inlet grille has: a fixed grille formed integrally with said top panel on the side of the rear end of said top panel; and a movable grille provided detachably from said top panel on the side of the front end thereof, and said filter is held by said movable grille and is attachable to or detachable from said top panel.

9. The air conditioner according to claim 8, characterized in that said filter includes a corrugated filter and a plane filter provided contiguously to one edge of said corrugated filter, and said corrugated filter is held by said movable grille.

10. The air conditioner according to claim 8, characterized in that said fixed grille is substantially parallel with an indoor ceiling surface and said movable grille is inclined obliquely downward.

11. The air conditioner according to claim 8, characterized in that on both sides of the rear end of said movable grille, there are formed bearing fitting channels which are rotatable to, attachable to and detachable from said fixed grill, and between the side of the front end of said movable grille and said top panel, there is provided engagement means consisting of an engagement projection and an elastically deformable engagement pawl.

12. The air conditioner according to claim 8, characterized in that on the side of the rear end of said movable grille, there is provided a grille retainer with respect to a front end frame of said fixed grille.

13. The air conditioner according to claim 12, characterized in that said grille retainer has two grille retainers for retaining said front end frame from both upper and lower sides.

14. An air conditioner having a body cabinet, comprising:

a base panel to be fixed to an indoor wall surface through predetermined fixing means;

a front panel formed like a ship bottom in cross section such that a rear end is latched to a lower end of said base panel and a front end side curves upwardly; and a top panel, the rear end of which is latched to a top end of said base panel and the front end of which is butted against the front end of said front panel, in which on said base panel, a cross flow fan and a box for electric are arranged side by side, and a heat exchanger and a drain pan are mounted; on the side of the rear end of said front panel, there is provided an air outlet port; and said top panel is provided with an air inlet grille having a filter, characterized in that said front panel includes a pair of left and right side plates formed so as to cover both side walls of said base panel; each side wall of said base panel is provided with a front panel guide for guiding said front panel to a latching position with respect to said base panel; and on the inner surface of each side plate of said front panel, there is formed a hook capable of sliding along said front panel guide.

15. The air conditioner according to claim 14, characterized in that said front panel guide is an L-character shaped body in cross section including a base plate substantially perpendicular to said side wall and a guide plate bent upwardly from said base plate, for forming a guide groove with said side wall, and that said hook is an inverted L-character shaped body in cross section including a hook body to be placed on the top end of said guide plate, and an engagement rib bent downward from said hook body, for entering said guide groove.

16. The air conditioner according to claim 14, characterized in that the front end of said front panel guide on the anti-base panel side is arranged at a lower position near the indoor floor surface than the rear end on said latching position side, and between the front end and the rear end of said front panel guide, there is provided a slope with a predetermined angle.

17. The air conditioner according to claim 16, characterized in that at a latching position of said base panel, there is provided a latching channel, and on said hook, there is formed a latching projection for being inserted and fitted in said latching channel, and that on sliding said hook along said front panel guide, said latching projection runs onto said slope and said front panel is inclined at a predetermined angle.

18. The air conditioner according to claim 14, characterized in that said guide plate is formed such that the groove width of said guide groove is wide on the front end side of said front panel guide on the anti-base panel side and becomes gradually narrower as the rear end side on said latching position side is reached.

19. The air conditioner according to claim 14, characterized in that on each side wall of said base panel, there is further provided a restriction guider for preventing said front panel from being lifted up higher than a predetermined height position on mounting said hook on said front panel guide.

20. The air conditioner according to claim 14, characterized in that said front panel has a screwing boss with respect to said base panel on the inner surface on the rear end side thereof, and said boss is provided with an inclined plane which inclines on the anti-base panel side.

21. The air conditioner according to claim 14, characterized in that at the front end of said( top panel, there is provided an engagement hole having an elastically deformable engagement pawl therein, and at the front end of said front panel, there is provided an engagement projection which is inserted and fitted in said engagement hole to be captured by said engagement pawl.

22. The air conditioner according to claim 14, characterized in that between said base panel and said front panel, there is provided uneven fitting means, and a predetermined portion of said front panel is supported by said base panel.

* * * * *